United States Patent [19]

Bril

[11] 4,246,983

[45] Jan. 27, 1981

[54] ELEVATOR CONTROL

[75] Inventor: John M. Bril, Moline, Ill.

[73] Assignee: Montgomery Elevator Company, Moline, Ill.

[21] Appl. No.: 892,308

[22] Filed: Mar. 31, 1978

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 4,037,688 | 7/1977 | Winkler | 187/29 |
| 4,042,067 | 8/1977 | Mandel | 187/29 |
| 4,114,730 | 9/1978 | Means et al. | 187/29 |
| 4,149,614 | 4/1979 | Mandel et al. | 187/29 |

*Primary Examiner*—Gene Z. Rubinson
*Assistant Examiner*—W. E. Duncanson, Jr.
*Attorney, Agent, or Firm*—Wegner, Stellman, McCord, Wood & Dalton

[57] ABSTRACT

An elevator control utilizing a data processor and which is sequentially responsive to independent program blocks. The control includes a central processing unit, programed read only memory and random access memory, with input and output circuits for interconnection between the control, the elevator, elevator drive and the structure in which the elevator operates. The memory has a capacity to store information for elevator systems and structures with a wide variety of parameters. Specific addresses in the memory are assigned for the input information and for elements of status information which provide for interaction between different portions of the program. The assigned addresses are common to all elevator controls, enabling use of standard program blocks and minimizing the original design work required for each control.

13 Claims, 32 Drawing Figures

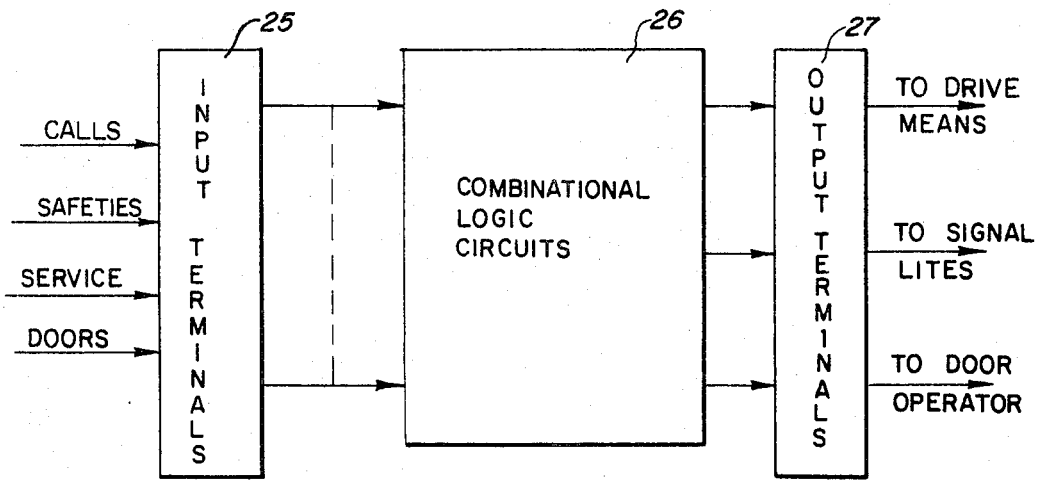
FIG. 1 PRIOR ART
FIG. 2
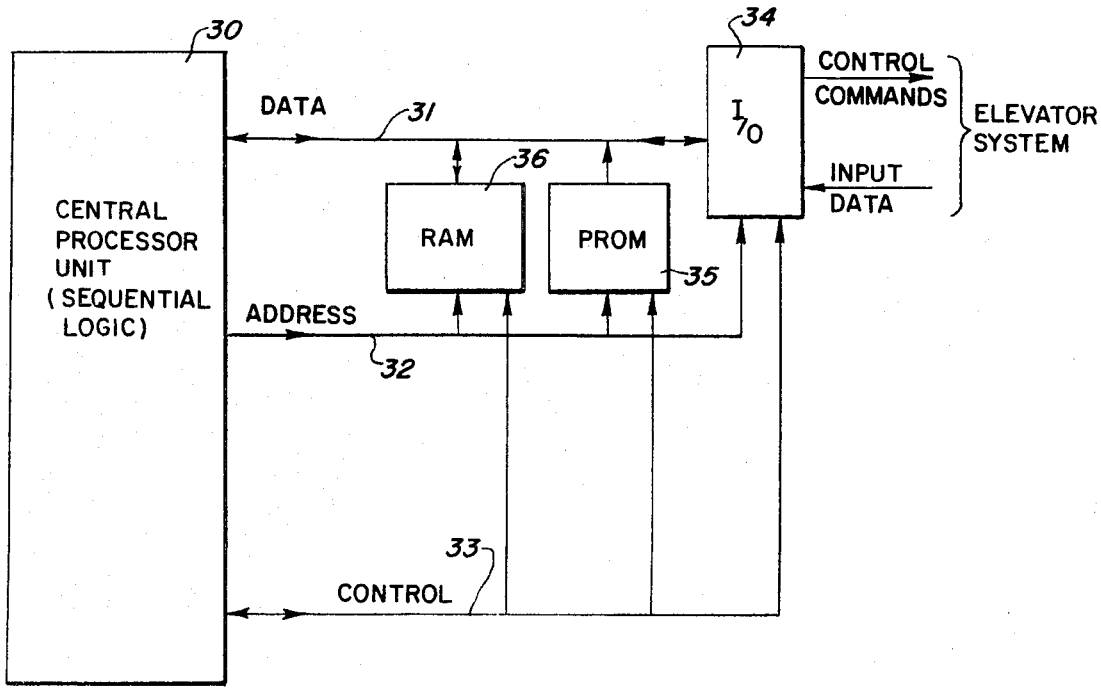

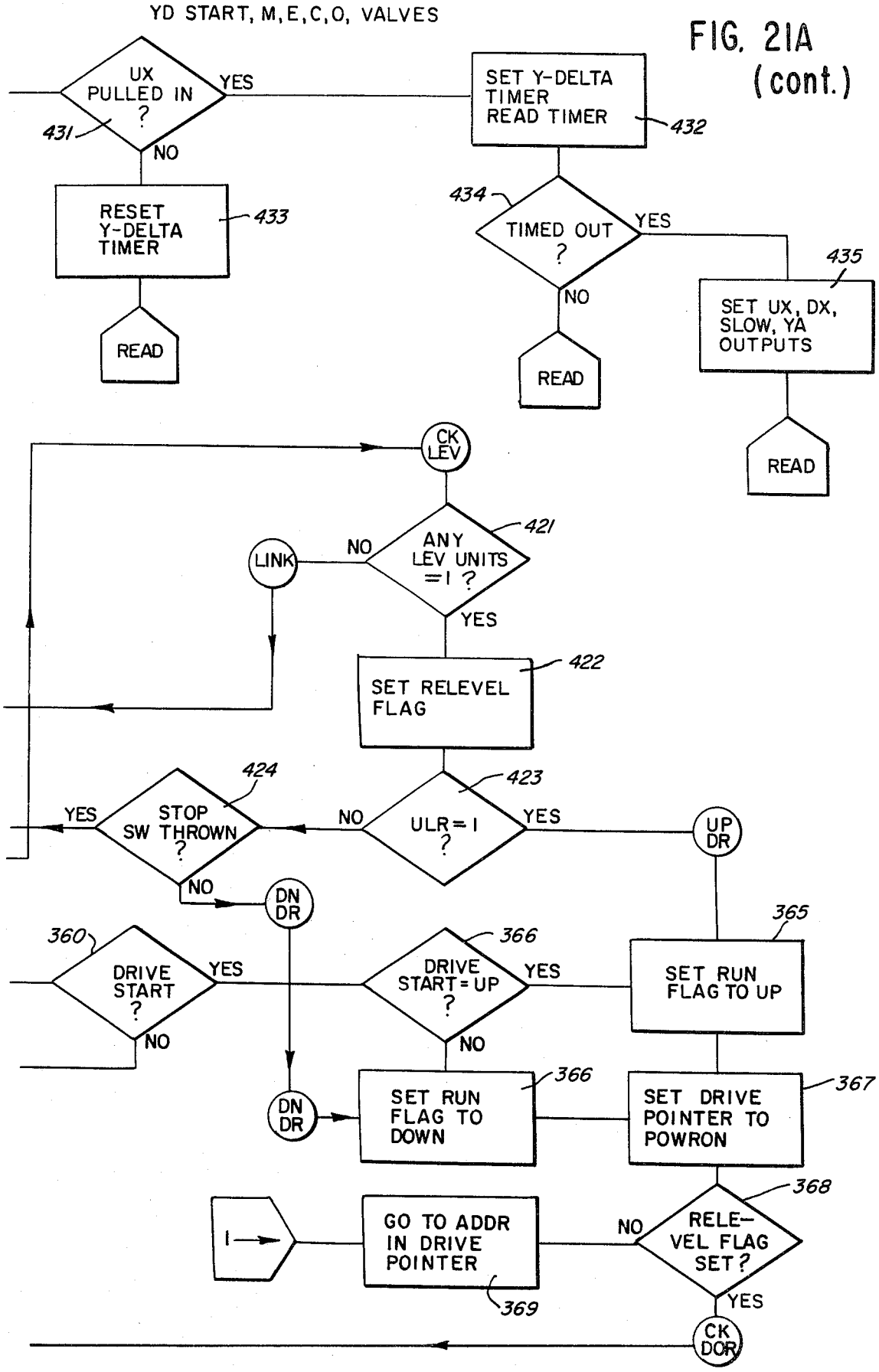
YD START, M,E,C,O, VALVES
FIG. 21A (cont.)
UX PULLED IN ?
YES
NO
431
SET Y-DELTA TIMER READ TIMER
432
RESET Y-DELTA TIMER
433
READ
434
TIMED OUT ?
YES
NO
READ
435
SET UX, DX, SLOW, YA OUTPUTS
READ
CK LEV
ANY LEV UNITS =1 ?
421
NO
YES
LINK
SET RELEVEL FLAG
422
ULR=1 ?
423
NO
YES
STOP SW THROWN ?
424
YES
NO
UP DR
DN DR
360
DRIVE START ?
YES
NO
DRIVE START=UP ?
366
YES
NO
SET RUN FLAG TO UP
365
DN DR
SET RUN FLAG TO DOWN
366
SET DRIVE POINTER TO POWRON
367
I
GO TO ADDR IN DRIVE POINTER
369
RELE-VEL FLAG SET ?
368
NO
YES
CK DOR

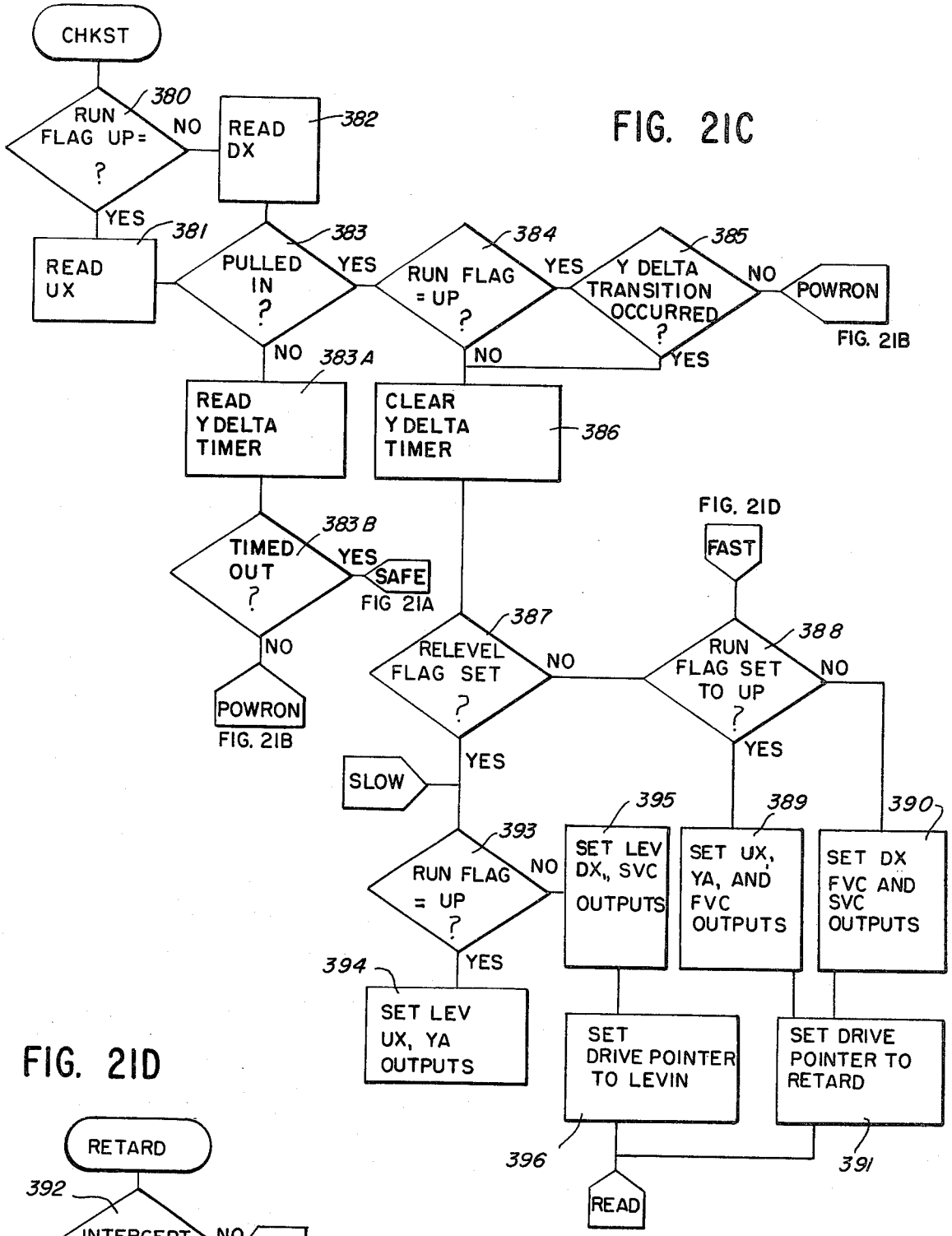
FIG. 21C
FIG. 21D
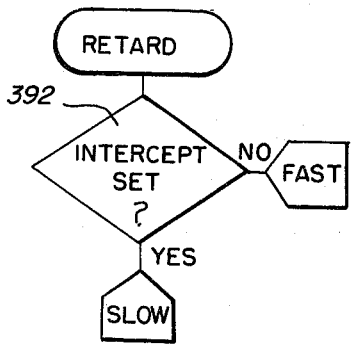
FIG. 21C

ELEVATOR CONTROL

This invention relates to an elevator control system, components thereof and to a method for controlling an elevator.

Prior efforts to implement sophisticated elevator controls utilizing electronic data processing techniques have made use of a combinational logic approach. Examples are:

| | |
|---|---|
| 3,851,733 | Sackin et al |
| 3,851,734 | Sackin |
| 3,851,735 | Winkler et al |
| 3,854,554 | Booker |
| 3,995,719 | Mandel et al |

This approach results in a duplication of many components and program functions and requires a substantial design effort to tailor the control for each elevator installation.

SUMMARY OF THE INVENTION

The present invention provides an elevator control utilizing a data processor with sequential logic which carries out independent program blocks, and a memory (RAM) having assigned address locations for input information and for status information through which the different program blocks interact. More particularly, the memory has a capacity and assigned addresses for input information of systems and structures with a range of physical and electrical parameters. Input circuits connected with sources of input information transmit the information to the memory. A programmed read only memory (PROM) has a series of sequential program function blocks for operating the elevator system. A central processor unit (CPU) connected with the memory and PROM carries out the sequential programs with respect to the system input information in the memory and generates control signals for the system. Output circuits connected with the central processor unit transmit control signals to the means for moving the elevator car and means for operating the doors thereof and to associated indicators and the like.

Another feature of the invention is the provision of a method of operating an elevator car including storing at assigned addresses in a memory input information concerning system condition, sequentially performing programs with respect to the information, transmitting control signals to means for moving the car and operating the doors thereof, and moving the car and operating the doors in accordance with the control signals.

A further feature is a method of assembling a control for an elevator system which includes establishing addresses in a memory for information regarding car and structure condition and service requirements for a range of system parameters, assigning input and output circuit means for the input information and output signals of a specific elevator car and structure, selecting sequential program blocks for the control, adapting the program blocks to the car and structure parameters and programming a memory to carry out the sequential program blocks.

Yet another feature of the invention is that it enables the establishment of an elevator control with selected ones of a variety of operating programs and that the programs for a control may readily be modified with little or no rewiring.

Still a further feature of the invention is that the relationship of the input and output circuits which are connected between the control and the elevator operating means may be arbitrarily established. The program provides for the appropriate addressing of data between the control and the elevator system.

And another feature of the invention is the provision of a universal input circuit which accepts either AC or DC signal information. The input circuit preferably includes optical isolating means to prevent undesired interaction between the control and the input information sources.

Another feature of the invention is that the control is provided with a safety circuit comprising a lost pulse detector which responds to the absence of either a clock pulse or alternating power to the system to shut down the control in the event of an unsafe condition.

And a further feature is that the central processor unit is operated at an elevated voltage level, above ground, and that a signal level transformation circuit is provided. This reduces the effect of noise on the control.

Further features and advantages of the invention will readily be apparent from the following specification and from the drawings, in which:

FIG. 1 is a block diagram of a prior art elevator control utilizing combinational logic;

FIG. 2 is a block diagram of a sequential logic control in accordance with the invention;

Figure 3A:
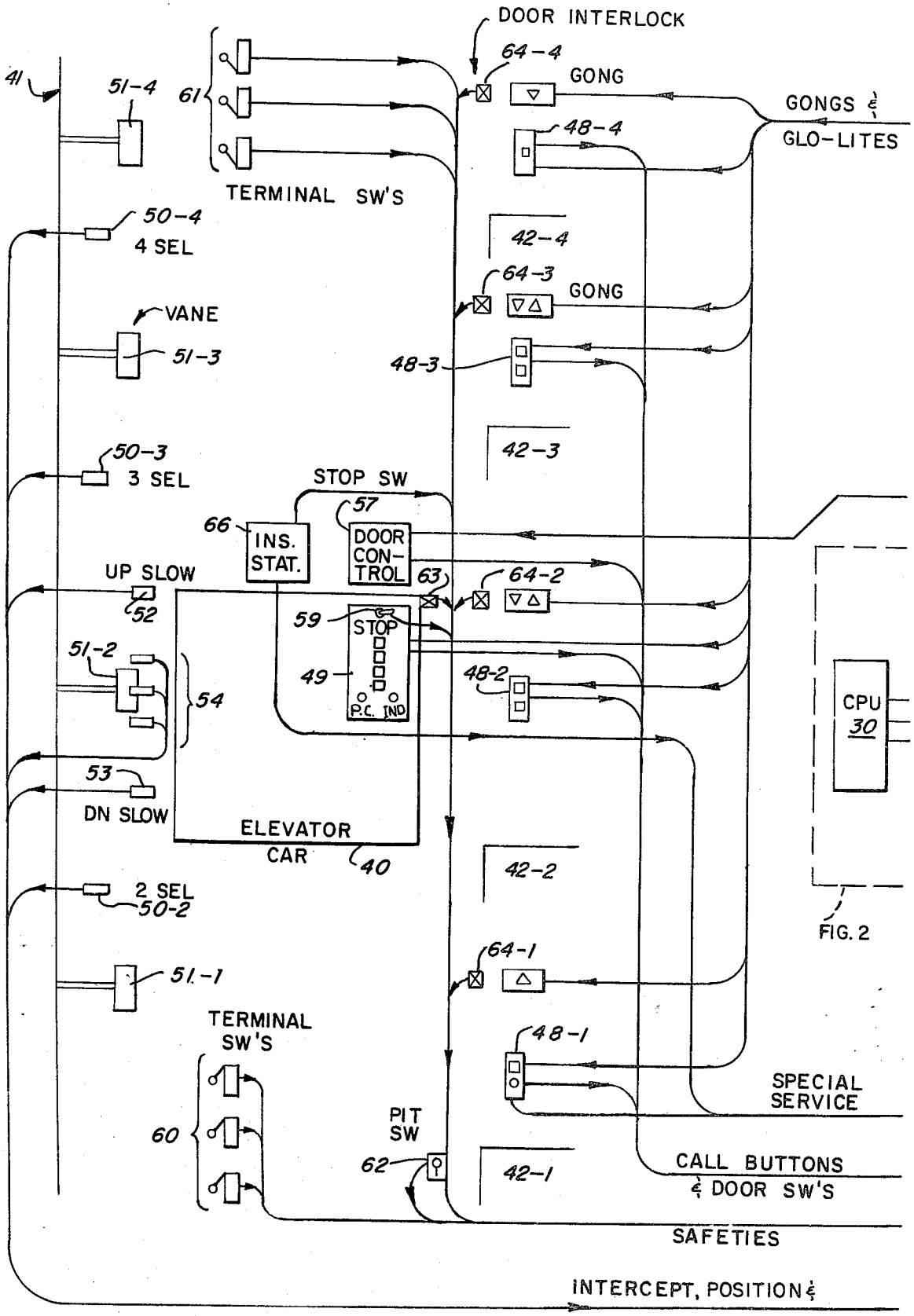
FIGS. 3A and 3B are a block diagram of an elevator system illustrating the invention.

During the rource of the following description and in the drawings, abbreviations will be used for many of the components and for various input, output and control signals and the like. The following is a glossary of some of these abbreviations:

| | |
|---|---|
| Addr | Address |
| CG | Car Gate |
| CHKST | Check Start |
| CPU | Central Processor Unit |
| DN | Down |
| DNDR | Down Drive |
| DOR | Door Open |
| DX | Down Direction |
| I/O | Input/Output |
| LED | Light Emitting Diode |
| LEV | Leveling |
| PC | Photocell |
| Powron | Power On |
| PROM | Programed Read Only Memories |
| PT | Protective Timer |
| RAM | Random Access Memory |
| SLP | Slow |

-continued

| | |
|---|---|
| UPDR | Up Drive |
| UX | Up Direction |
| YΔ | Wye-Delta |

The prior art system illustrated in FIG. 1 has a set of input terminals 25 to which are connected the various input signals relevant to elevator operation from the elevator and the structure in which it operates. Typical input signals include car and hall calls, safety circuits, a selection of the type of service to be provided, car and door position and the like. In a combinational logic system, the appropriate input signal information is connected with suitable logic circuits 26 (not illustrated in detail) which respond thereto and provide appropriate control signals through output terminals 27. The control signals are connected, for example, to the elevator drive means, door operator and to signal lights or gongs in the car and in the halls of the structure.

All input signals are coupled in parallel to the combinational logic circuit and all control signals are coupled in parallel to the circuits controlled thereby. This requires independent input and output buffer amplifiers for each input and output signal. Moreover, control logic circuits must be provided for each comparison or calculation which is performed by the combinational logic circuit 26. There is little opportunity for interconnection to minimize redundant circuit functions. To the extent that there are interconnections, a change in one circuit may require a change in another. The design of a combinational logic circuit is as complex as that of a relay elevator control; and field modification is difficult.

FIG. 2 illustrates in simplified block form an elevator control system in accordance with the invention, which makes use of a "microprocessor" or central processor unit (CPU) 30 and appropriate memory units. CPU 30 has a data carrier or a bus 31 over which data is received and transmitted. Address carrier or bus 32 handles instructions from CPU 30 regarding the source of data signals to be received or the destination of signals which are transmitted. Control bus 33 distributes suitable timing and other control information to the elements of the elevator control. Each of the buses 31, 32, 33 comprise multi-channel connections for the parallel or simultaneous transmission of signals.

The elevator control further includes input/output circuits (I/O) 34 through which input data is received from the elevator system and control commands are directed to the system. A programmable read only memory (PROM) 35 stores the programs which are utilized to control the elevator system, as will appear. A random access (RAM) 36 provides temporary storage for data representing conditions in the elevator system and for signals which may require storage at an intermediate point in a program or to provide for interaction between various programs or portions of programs. Some of these signals are referred to herein as "flags".

The control illustrated is for a single elevator car, sometimes termed a Simplex system. However, many aspects of the control may also be used in a two car (Duplex) or plural car (Multiplex) system. As will appear in more detail below, the memory capacity of RAM 36 exceeds the requirements for data storage capability of the most complex installation it is anticipated will be encountered. For example, a hydraulic elevator is limited by mechanical factors in the number of floors which it can serve. Accordingly, the hydraulic elevator control memory capacity is selected to be greater than that which would be required for a structure with the maximum floors and the various functional options, e.g., rear doors, floor signals, etc. Fixed relative memory locations (addresses) are established for all of the input data and for program interaction data or flags. This basic control combination enables the establishment of a library of typical program blocks which may be used in compiling a program for a specific elevator installation. The PROM is programed to correlate the I/O circuits 34 with the assigned memory addresses so that the I/O assignment may be tailored to the particular system while each control program block need not be rewritten for the specific I/O configuration. The control of FIG. 2 affords a high degree of flexibility in interfacing the control with a specific elevator environment and a capability of using common operating program blocks, test equipment procedures and further may readily be modified to include new program functions with little or no hardware changes.

Figure 3B:
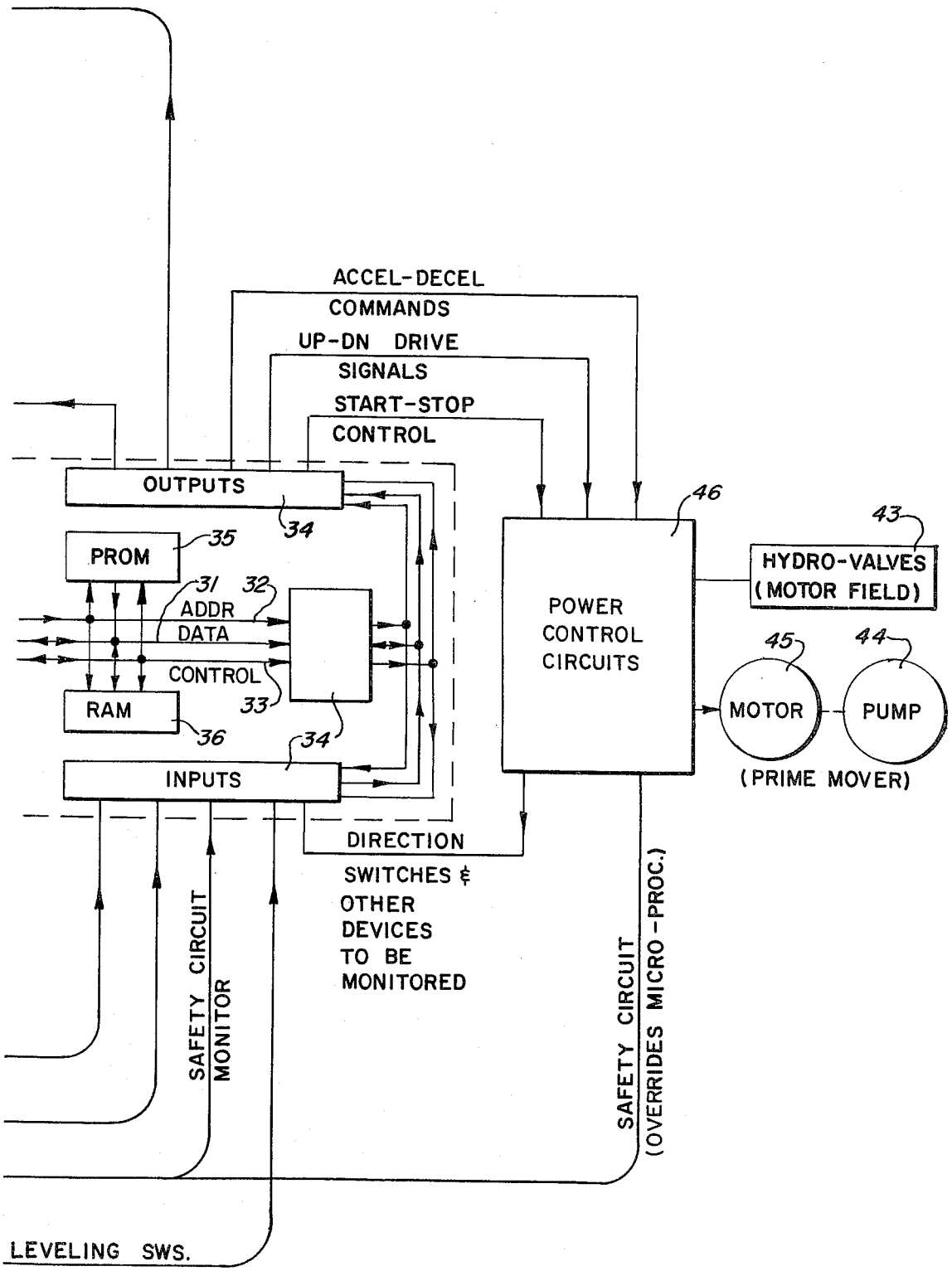

FIGS. 3A and 3B illustrate diagrammatically the interconnection of the control of FIG. 2 with various input signal sources and elevator operator mechanisms in a typical elevator system. The specific system shown is for a hydraulically driven elevator. Some of the differences which might be found in a cable-supported elevator will be mentioned during the following description. Individual input and output signal connections to the controller are not shown in detail. Rather, similar or related connections are grouped in lines identified by appropriate legends.

Elevator car 40 serves a structure 41 having landings or floors 42-1, 42-2, 42-3 and 42-4. The hydraulic mechanism for moving car 40 (not shown) is actuated under the control of hydraulic valves 43 which direct hydraulic fluid from a pump 44 driven by motor 45. The valves 43 provide for starting and stopping the elevator car 40 and for determining the direction in which it moves. In a cable system motor 45 drives a hoist mechanism and the connection of the motor field windings determines the direction of car movement.

Data inputs for the control are derived from several different sources. Elevator service demand is indicated by the registration of hall and car calls through the actuation of hall call switches 48-1, 48-2, 48-3 and 48-4 at each landing or car call switches 49. There are up and down call switches at intermediate floors, an up call switch at the lowest floor and a down call switch at the highest floor. The position of elevator car 40 in the hatchway is detected by sensors 50-2, 50-3 and 50-4 located adjacent the path of the car and actuated by the car's presence. Vanes 51-1, 51-2, 51-3 and 51-4 are located in the hatchway for each landing. Vane sensors 52, 53 on the elevator car provide a car position signal relative to the vane for initiating a slow-down upon interception of a vane at a floor where the car is to stop. Leveling sensors 54 respond to the floor vane 51-1, 51-2, 51-3 and 51-4 to control the valves 43 and motor 45, bringing car 40 to a stop in alignment with the landing.

Door control 57 provides information to the elevator control regarding the door position, which is a factor in actuating the door operator to open and close the door, and from sensors as a light beam and photocell or a door edge switch which respond to a passenger or object in the doorway to prevent the doors from being closed.

Safety signal sources are connected both with the input circuit 34 of the elevator control and directly with the power control circuits 46 affording an override of the control in the event of a malfunction. Safety inputs include a manual stop switch 59 on the elevator car, a series of terminal switches 60, 61 limiting the car travel at the first and fourth landings, respectively, and pit switch 62 provides a further safety limiting descent below landing 1. Door interlock 63 is provided for the door on elevator car 40 and individual door interlocks 64-1, 64-2, 64-3 and 64-4 are provided for the doors at each of the landings. The car should not run unless all doors are closed.

In normal operation, the elevator car will provide service under the direction of the control to answer car and hall calls. There are situations where other types of service are required, as during inspection or in the event of an emergency when authorized personnel may provide an overriding control input. This is typically accomplished by actuation of key control switches at an inspection station 66, through the control panel 49 in the car or at the control panel 48-1 for home landing 42-1.

Output signals for controlling three different functions are connected from the control to the power control circuits 46. These include up and down direction signals, start and stop signals and acceleration and deceleration signals. The various signals are utilized to actuate the hydraulic valves 43 or motor 45 or both. Some of the elements of the power control circuits are monitored to provide inputs to the control. These include direction switches, etc. Output signals from the control also actuate door control 57 causing the doors to open and close in an appropriate manner.

Further output signals from the control light the car and hall call buttons to indicate the registration of service calls and actuate gongs (which may also be lighted) at each landing to indicate car location and direction. Output signals may also be utilized to actuate a car position indicator (not shown) which is often provided in an elevator car or at the home landing.

The signal sources or data inputs and the control signal outputs illustrated in FIG. 3 are typical. Each elevator car installation may, however, have specific requirements which will permit the elimination of some of the signals and circuits shown or require additional data inputs or control signal outputs. The control of this invention is readily adapted to such diverse system requirements.

Figure 4:
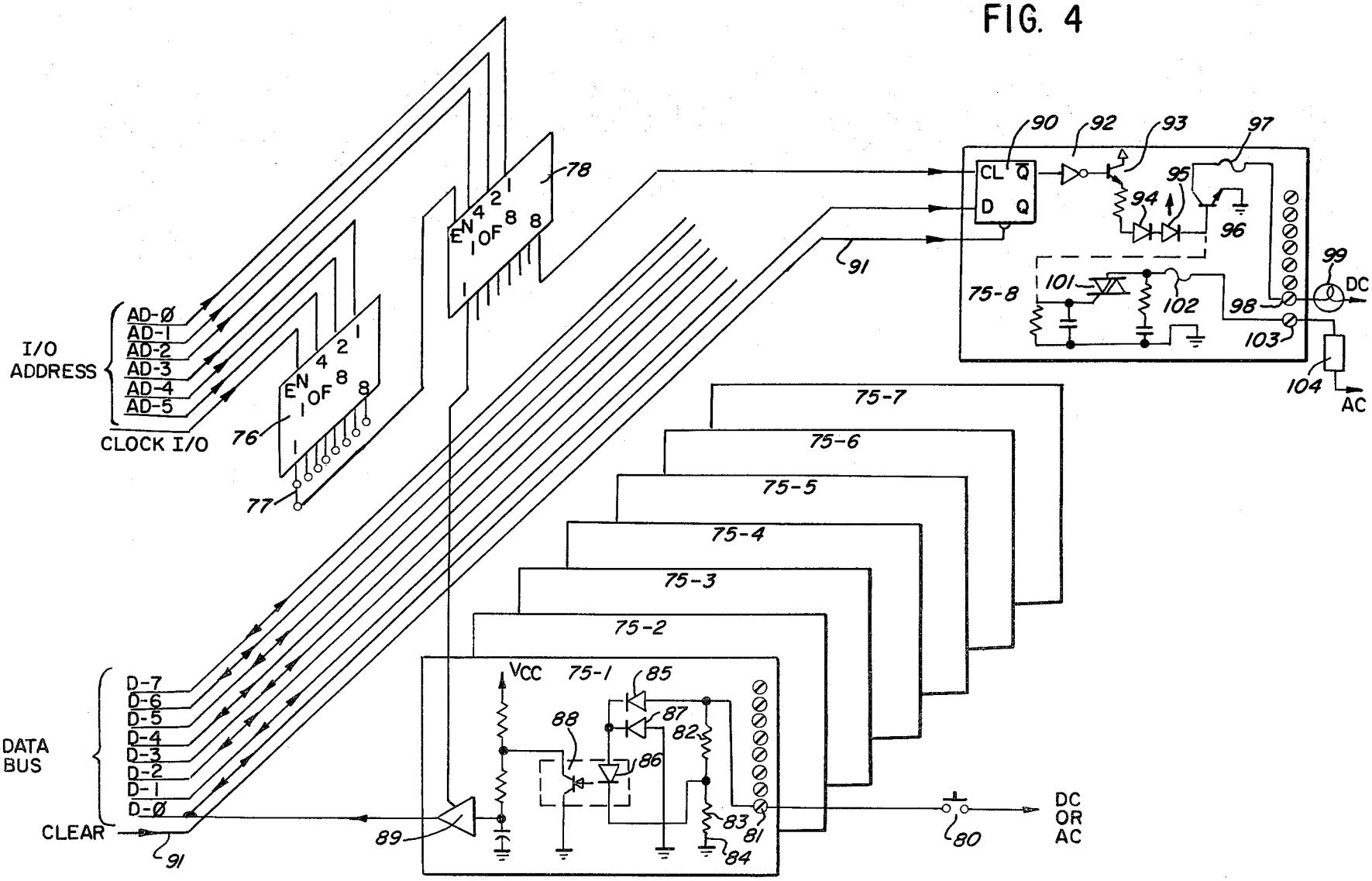
FIG. 4 is a circuit diagram of typical input and output circuits utilized in the control.

FIG. 4 illustrates input and output circuits which provide the interface between the control and the elevator environment. The circuit shown uses up to eight racks of circuit cards, each rack having eight cards 75-1, 75-2, 75-3, 75-4, 75-5, 75-6, 75-7, 75-8, and each card having eight individual input or output circuits thereon. In FIG. 4 typical input and output circuits are shown. This combination of eight racks of eight cards with eight circuits each is selected to operate with a six digit binary address code and an eight line data bus. Three address digits identify the card rack and the other three identify the card. Up to eight data bits are handled simultaneously. If more than 512 inputs and outputs are required, a higher order address code may be used.

A universal input circuit is utilized which responds to either an AC or a DC information signal. Output circuits are provided either for a DC or for an AC load. In a preferred implementation of the system, four types of input-output (I/O) cards are utilized: a card with eight universal input circuits; a card with eight DC outputs; a card with eight AC outputs; and a card with four DC and four AC outputs. This provides a convenient mix of circuits with which the control can be tailored for a particular system without waste of I/O circuit capabilities.

In FIG. 4 card 75-1 illustrates one of the universal input circuits. Card 75-8 illustrates both the DC and AC output circuits.

Each of the eight circuits on a card is connected with a different one of the eight data lines D1-D7 of the data bus and the circuits are activated simultaneously. Two 1 of 8 decoders respond to the address signals and select the rack and card to be queried for input signals or to be actuated by output signals. Decorder 76 responds to three address bits and an enabling clock signal to select the card rack. The outputs of decoder 76 are connected, as by jumper wires 77, with each of the card racks used. Decoder 78 is enabled by the output of decoder 76 and responds to three other address signals to actuate all of the circuits of a single card.

The typical input circuit illustrated with card 75-1 is a switch 80 with a source of power which may be 45 volts DC or 110 volts AC. The external circuit is connected with a terminal 81, the board having eight such terminals, one for each input circuit thereon. A resistive voltage divider having two series connected resistors 82, 83, is connected from the terminal to a reference potential or circuit ground 84. Diode 85 is connected from the terminal through light emitting diode (LED) 86 across resistor 82. A second diode 87 is connected from the junction between diode 85 and LED 86 to ground and is poled oppositely to diode 85, minimizing the inverse voltage applied to LED 86 with an AC input signal. LED 86 is actuated by either the DC or rectified AC signal. Light from LED 86 is sensed by phototransistor 87 and a data signal is generated which is coupled through tristate buffer 89 to the appropriate data line. Buffer 89 is actuated by the card enabling signal from decoder 78 and has either a high or low output indicating the presence or absence of an input signal. The output of buffer 89 appears as a high impedance in the absence of an enabling signal.

Output control signals are connected from the lines of the data bus with flipflop circuits 90, there being one for each output circuit. Prior to the transmission of output data, each of the flipflops on the output board is cleared by a signal on line 91. The card to which output data is to be transmitted is selected by the address signal and the 1 of 8 decoders 76, 78 as discussed above. The output signal on each data line establishes the condition of the appropriate flipflop. An output of the flipflop is connected to the buffer amplifier 92 with transistor switch 93. When the transistor conducts the signal is coupled through blocking diode 94 and LED 95 with an appropriate output circuit. For a DC load, the current from transistor switch 93 actuates a second transistor switch 96 connected through a fuse 97 to terminal 98. The external load, as a lamp 99, is connected with the terminal and to a DC source. The circuit for an AC load includes a gated switch, as Triac 101, which has its gate element connected with the output of transistor 93, indicated by a broken line connection. The load circuit of the Triac is connected through fuse 102 with terminal 103. The external AC load 104 is connected between the terminal and an AC source.

Figure 5:
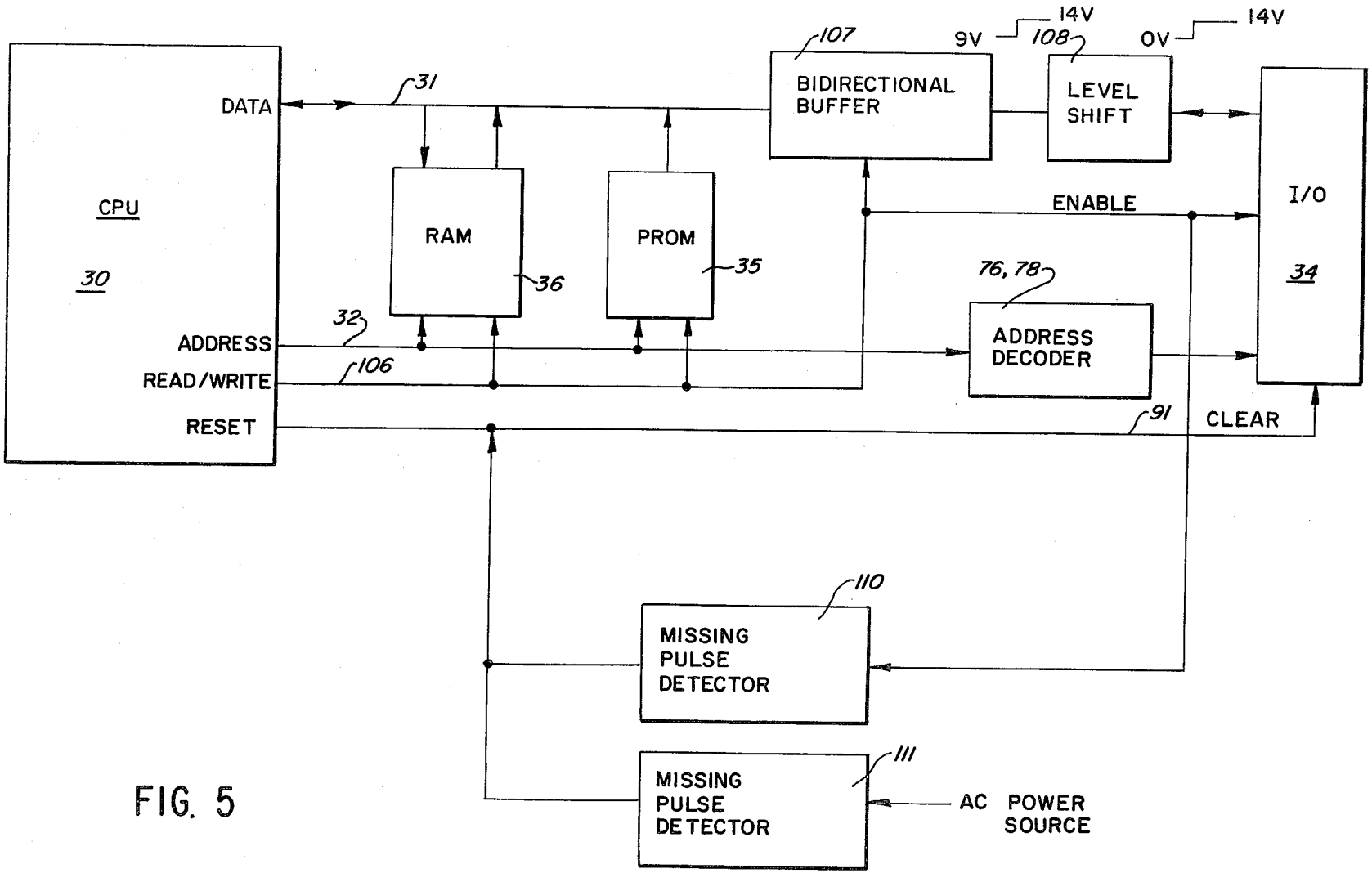
FIG. 5 is a block diagram of the control shown in more detail than in FIG. 2.

FIG. 5 shows the control in block diagram form with more detail than in FIG. 2. Some of the signal buffers and control signals have been omitted to avoid details that do not contribute to an understanding of the invention.

CPU 30 provides address signals and read/write control signals under the supervision of programs from the PROM 35. The read-write output of the CPU is connected with PROM 35 and RAM 36, with a bidirectional signal buffer 107 connected in data bus 31 and further establishes an enable signal for I/O circuits 34. Data bus 31 provides two-way communication among the CPU 30, RAM 36 and the elevator system through I/O circuits 34. Information is also coupled to the CPU 30 from PROM 35 through the data bus. Bidirectional buffer 107 preferably includes two sets of buffer amplifiers; one for transmitting input signals to the control, and the other for transmitting output signals from the control to the elevator system. The appropriate set of buffers is actuated by read/write signals from CPU 30 on line 106.

CPU 30 is preferably operated at an elevated voltage level, as nine volts positive, rather than at reference or ground potential. The CPU circuits are referenced to ground by their connection to the 14 volt supply. This minimizes the influence of ground circuit noise on the CPU. Accordingly, a bidirectional level shift circuit 108 is connected between buffers 107 and the I/O circuits 34. The level shift circuit accommodates signal levels of 0–14 volts in the I/O circuits 34 and of 9–14 volts at the CPU 30.

Read/write control signal outputs from CPU 30 are connected with PROM 35 and RAM 36 to control reading of information at appropriate addresses therein and to control the storage of information at selected addresses in RAM 36. The read/write control signals also actuate the appropriate sections of bidirectional buffer 107; and the signals are combined to provide the enable signal for I/O circuits 34.

The enable signal is also utilized as an input for a safety circuit including missing pulse detector 110. A second missing pulse detector 111 receives an input from the AC power source. In the event of a disruption of the enable signal or of the AC power signal, CPU 30 is reset and the output flipflops are cleared to insure that the system does not operate with erroneous information.

SEQUENTIAL OPERATION

Figure 6:
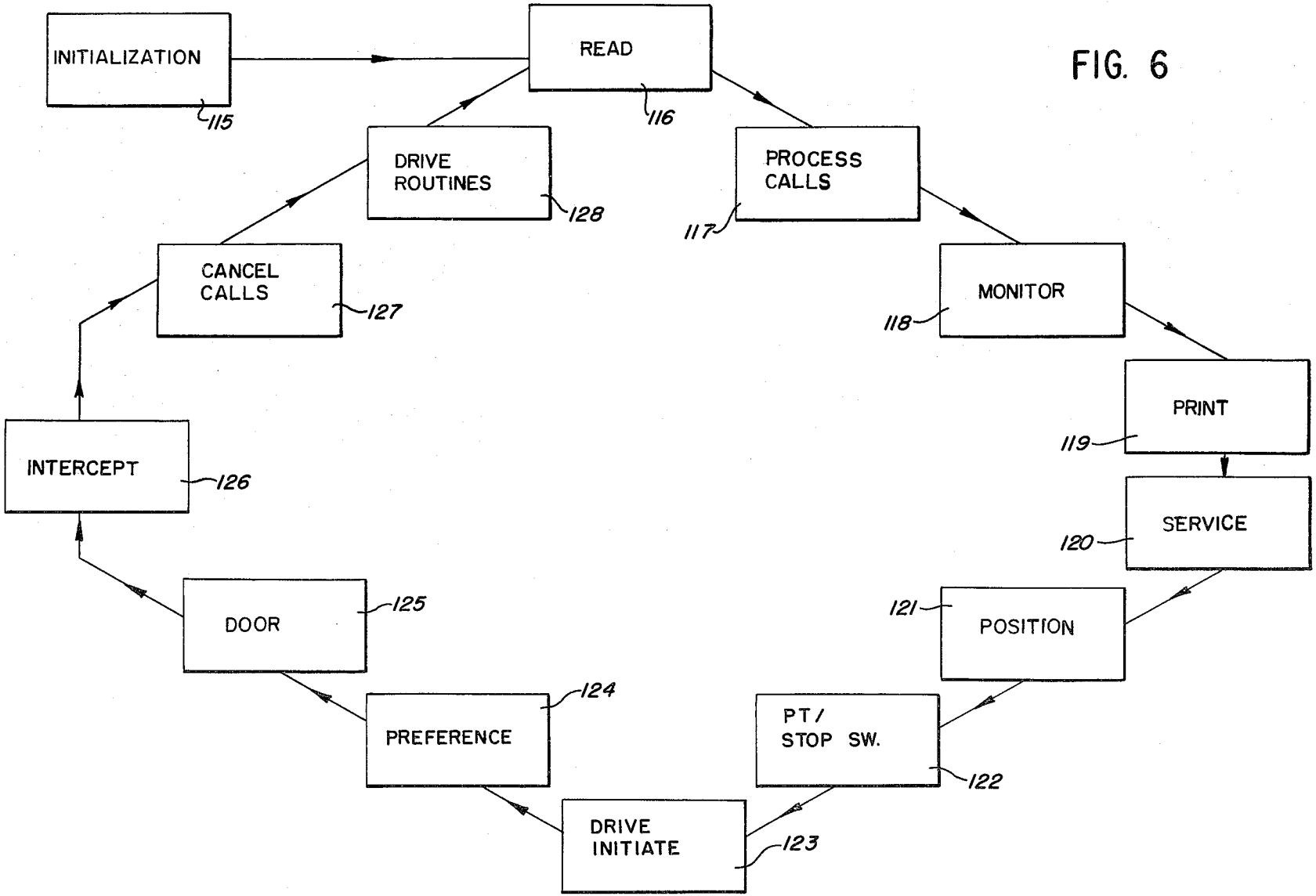
FIGS. 6 and 7 are flow charts showing a typical program sequence for the elevator control.

Operation of the control is illustrated in FIG. 6 with a typical sequence of program function blocks for a hydraulic elevator. Details of each program block will be discussed below.

Figure 7:
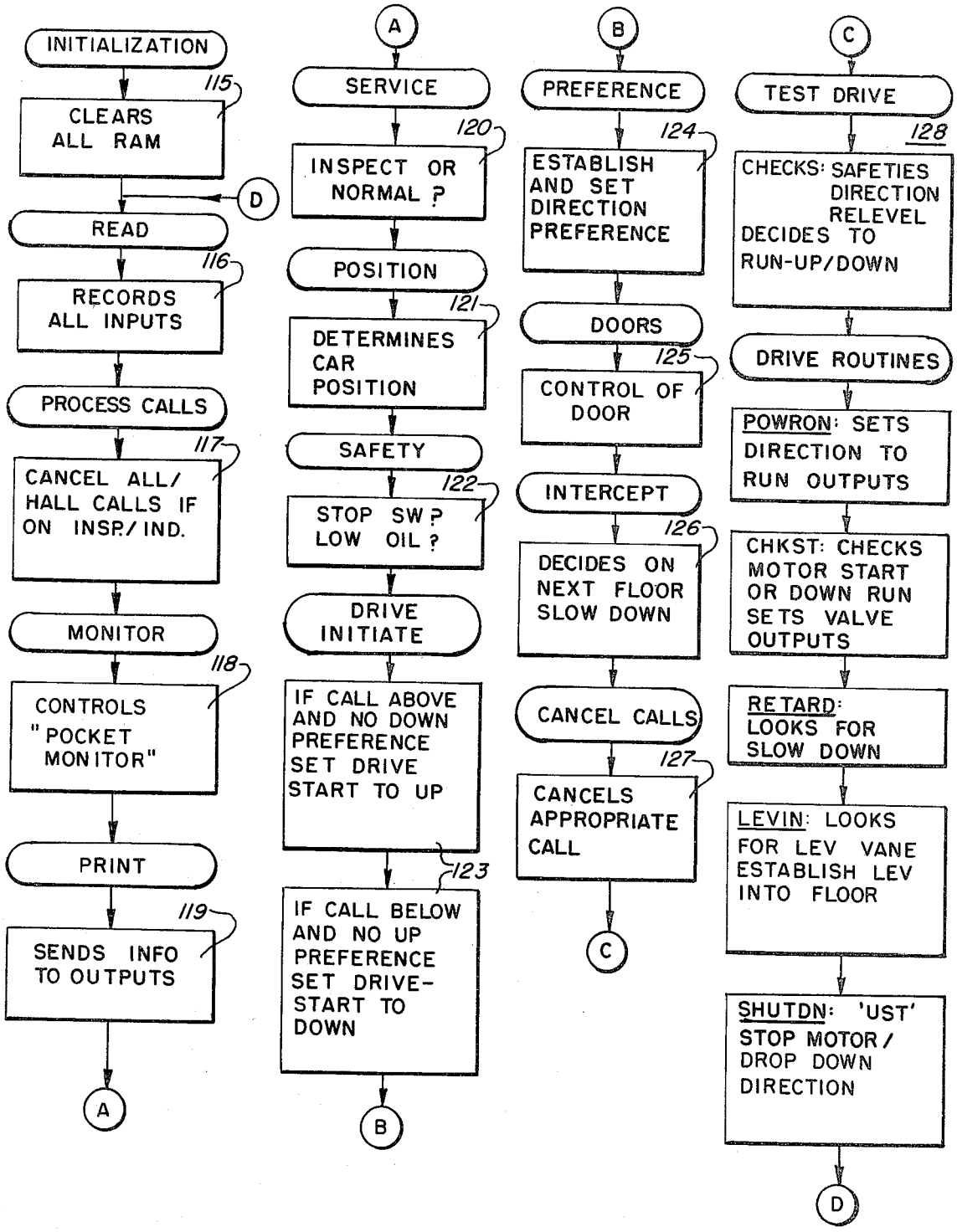

Upon start-up of the system or with reset following loss of an enable or power pulse, an Initialization program, block 115, is executed. The control then proceeds seriatim through the various program routines included in the control. Upon completion, the series of program routines is repeated. The time required to complete the sequence of programs illustrated in FIGS. 6 and 7 is of the order of 40 milliseconds.

The first program routine is a Read function block 116, during which the various system inputs are examined and information is stored in RAM 36.

As discussed above, the I/O and intermediate function or "flag"data is stored in RAM 36 at addresses which are assigned in a manner that enables the handling of information for a system of maximum complexity. Thus, the relation of data addresses is fixed for all elevator systems which are designed. This common characteristic enables use of standard programming in the controls for different elevator cars. During assembly of the elevator program from a collection of standard program units or blocks, a table or index is developed which correlates each input and output terminal (i.e., identified by rack, card and circuit) with the address for the corresponding data element in the RAM. In each elevator control, the actual I/O address for a given data bit may differ, but the relationships of the data bits in the RAM are the same so that a fixed address transformation or offset may be utilized. "Masks" are also established to prevent the transmission of erroneous data information from RAM addresses which are not used. These constraints on data storage enable use of standard programs, minimizing the programming and engineering effort required to generate each elevator control. The saving in design cost far outweighs the expense of unused memory capacity.

After all inputs are read and the data stored at the appropriate memory addresses, calls are processed as indicated by block 117. If the system is functioning on other than a normal service mode, certain calls will be canceled and will not be answered.

Block 118 provides for special operation if a serviceman is monitoring the control.

The Print function of block 119 selects data from the memory to be coupled sequentially with the output circuits, providing control signals to the elevator system. The Service function, block 120, clears certain information flags (sometimes referred to herein as dynamic flags) and determines whether the system is to proceed with Normal service or is conditioned for inspection or other special service.

Block 121 carries out a check of the elevator car location in the hoist way as indicated by position sensors 50-2, 50-3 and 50-4, FIG. 3.

Block 122 checks two safeties, the hydraulic system protective timer (PT) and the manual stop watch. Unless one of the two safeties orders that the system be shut down, Drive Initiate function block 123 is carried out. This routine determines whether there are calls on the system which require movement of the elevator car. If initiation of the drive is in order, the Preference function block 124 determines whether the car is to travel up or down. The Door function block 125 checks the condition of the car (e.g., stopped or moving), door safety and control inputs, and establishes output signals which cause the doors to open and close as required.

Intercept block 126 checks whether a car or hall call requires that the car slow down and stop at the floor which it is approaching.

Program block 127 cancels registered calls which have been answered.

The Drive routine block 128 checks the safety circuits, determines which direction the car should run, and controls the application of power to the elevator drive. Following execution of the Drive routine, the program returns to the Read function block 116.

Each of the program blocks will be described in more detail, with reference to the simplified flow charts of FIGS. 2-21.

INITIALIZATION

Figure 8:
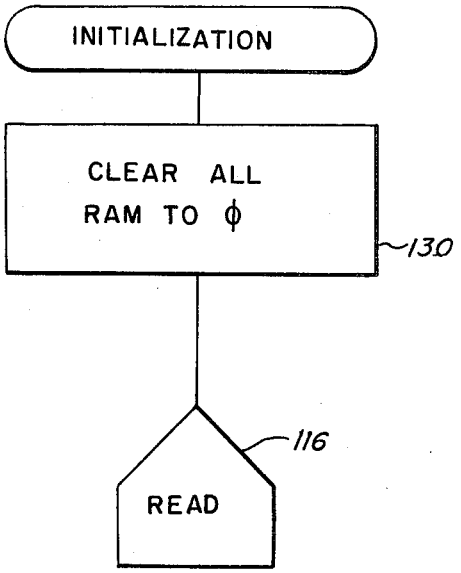
FIGS. 8–21 are simplified flow charts for typical program blocks or routines utilized in the elevator control.

The Initialization routine is illustrated by the flow chart of FIG. 8 and comprises the clearing of all RAM positions to zero as shown by step 130. The program then proceeds to the Read routine block 116, FIG. 9.

READ

The first step 132 in the Read routine includes initiation of the I/O board Pointer selecting the input circuits to be read, and the Table Pointer which correlates input information and RAM address. In step 133, each of the circuits of the selected input board (FIG. 4) is read simultaneously and the data stored in a temporary memory location, sometimes referred to as a "scratch pad" portion of the RAM. The board may be read twice and the readings compared to insure accuracy (not shown). The data is then transferred serially to the appropriate RAM addresses. Mask information is read from the Table Pointer in step 134. Step 135 determines whether the mask is equal to zero. If it is not, the address displacement for the data is determined from the address table at step 136. In step 137 the data is stored in the RAM. The program then again reads the mask from the Table Pointer as indicated by the terminal A. If the mask is now zero, indicating that all data has properly been displaced and stored, step 138 determines whether the board was the last to be read. If it was not, the I/O board Pointer is incremented at step 139. When the last board has been read and the data stored, the routine ends.

PROCESS CALLS

Figure 10:
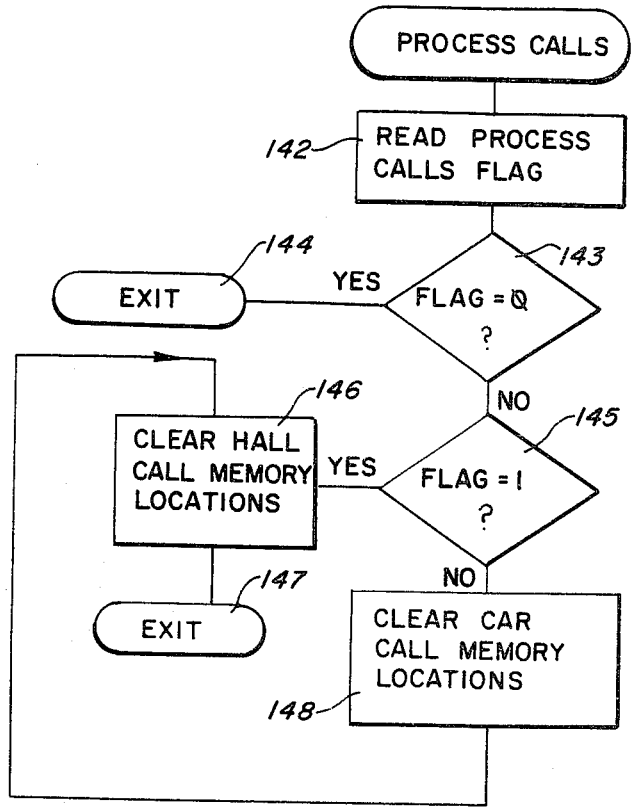

The flow chart of FIG. 10 illustrates the routine for clearing certain calls in the event the system is set for special service as Inspect or Emergency. In the first step 142, the Process Calls flag is read. This flag is an indication of selected conditions of special service. In step 143, it is determined whether the flag is 0. If it is, the program exits at terminal 144. If the flag is not 0, a determination is made whether the flag is 1 at step 145. If the answer is Yes, Hall call memory locations are cleared in step 146 and the program exits at 147. If the flag is neither 0 nor 1, Car call memory locations are cleared at 148 and the program then proceeds to clear the Hall call memory locations at 146 and exits at 147.

MONITOR

Figure 11:
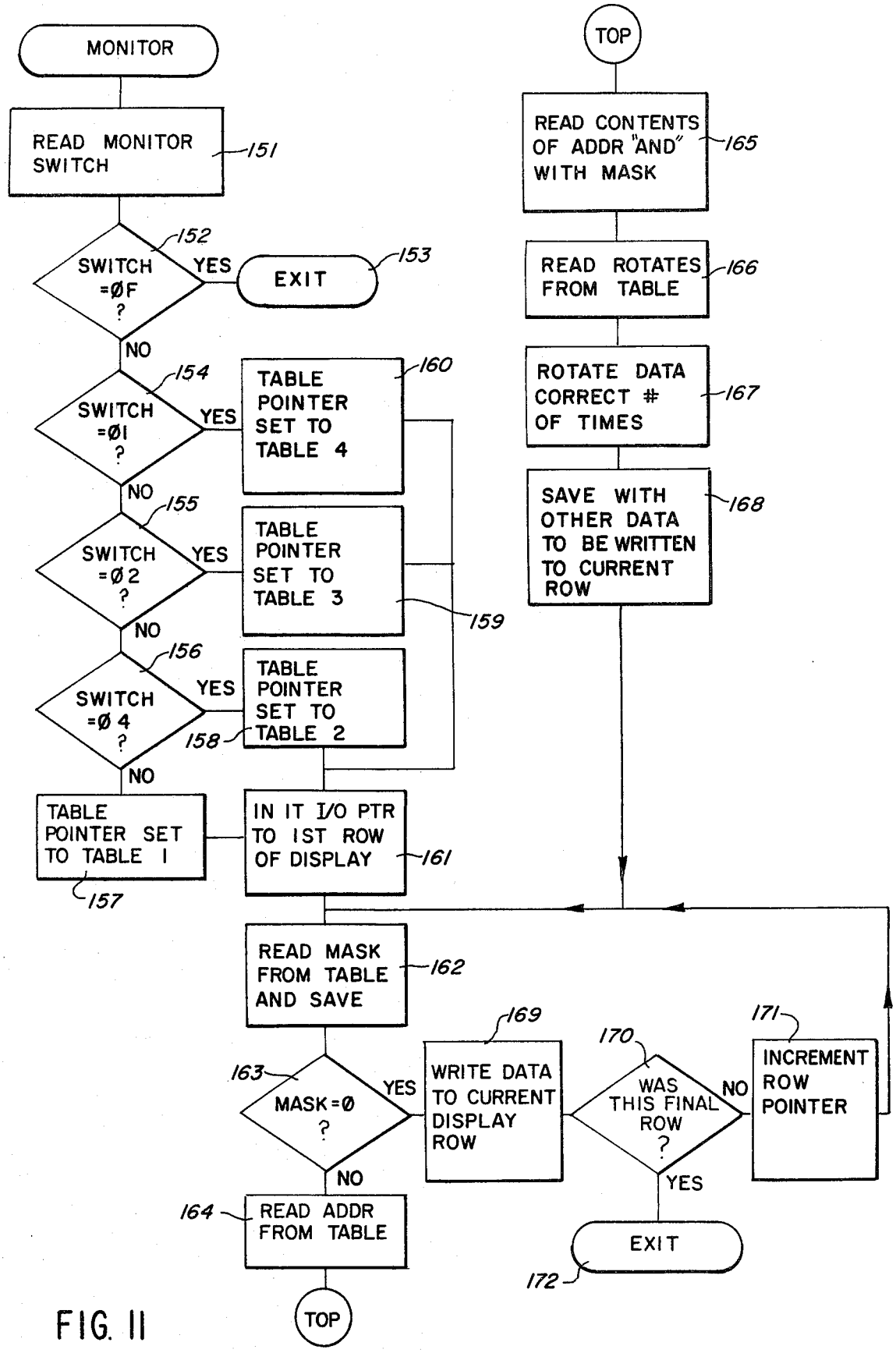

The routine of FIG. 11 is concerned with providing information from the RAM to a serviceman's monitor (not shown) which may be connected with the control. The monitor has a visual display in which data conditions within the control and selected by switches on the monitor are indicated as by lighting lamps. In this routine, the Monitor switch is read in the first step 151. At step 152, a determination is made whether the switch is off. If it is, the program exits at 153. If the switch is not off, steps 154, 155 and 156 determine which switch is actuated and the appropriate Table Pointer is set in steps 157, 158, 159 and 160. Then in step 161, the I/O pointer is set to the first row of the display. In step 162, a data mask is read from the appropriate table and saved. So long as the mask is not 0 at step 163, an appropriate data address is read from the table at step 164, the data at the address is read at 165 and is compared with the mask. The number of data rotations is determined from the table at step 166, the data is rotated at step 167 and is then saved with the data to be written in the display at step 168. The routine then returns to steps 162 and 163. If the mask is now equal to 0 indicating that all of the data for the display row is available, the data is written at step 169. At step 170 it is determined whether the final row of data has been displayed. If it has not, the row pointer is incremented at step 171 and the routine returns to read the next mask from the table at step 162, proceeding as discussed above. When the final row has been displayed, the program exits at 172.

PRINT

Figure 12:
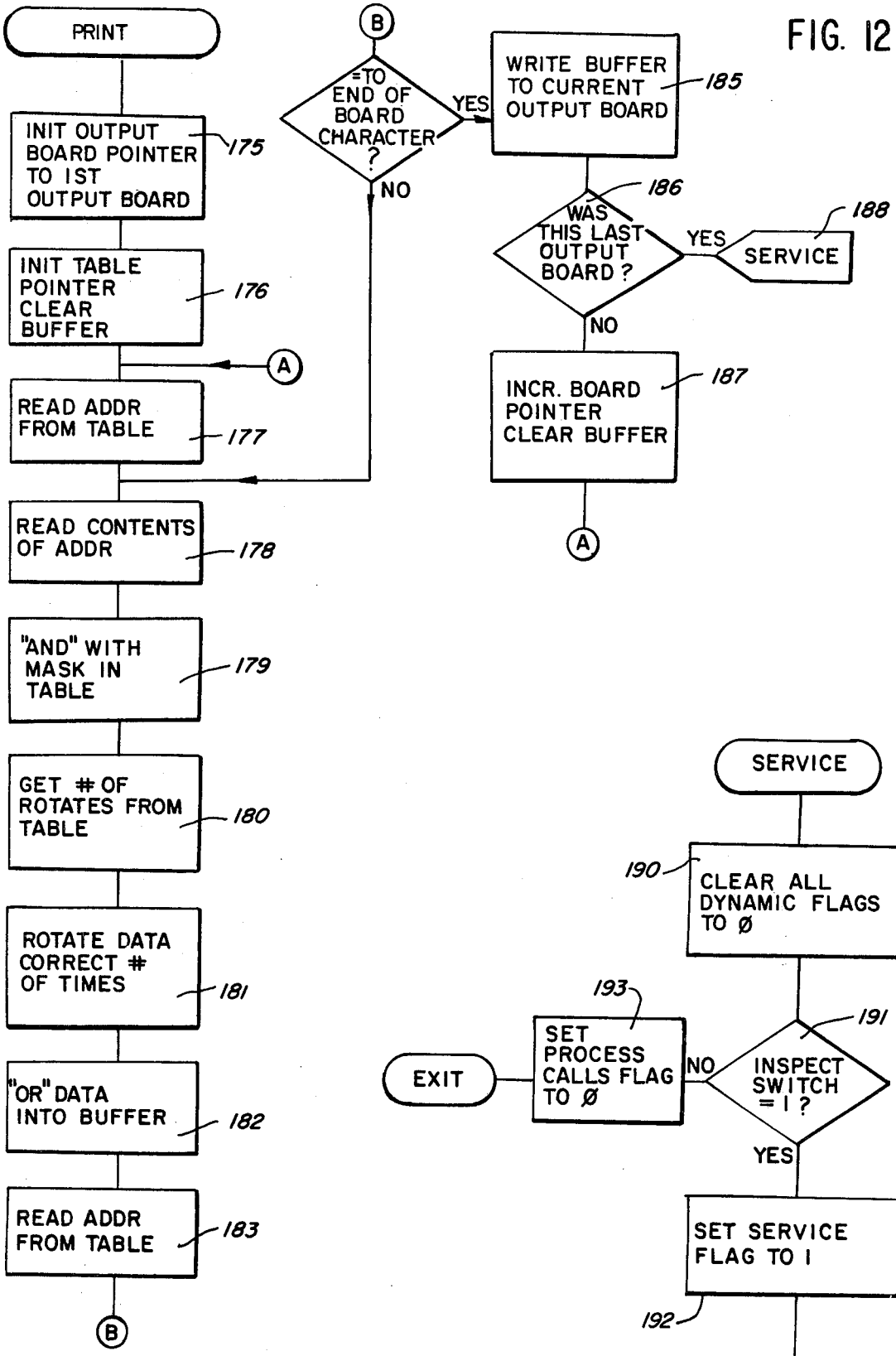

FIG. 12 illustrates the Print routine by which control information is connected through the output circuits to the elevator system. In the first step 175, the output board pointer is set to the first output board address. At step 176, the Table Pointer is initiated and a temporary data buffer, or scratch pad location, in RAM 36 is cleared. Step 177 reads the first address for the data from the table. The contents of the appropriate RAM address is read at step 178. The data is compared with the mask at step 179 to eliminate data from unused address positions. The number of data rotations is obtained from the table at step 180 and the data is rotated at step 181 for proper correlation with the lines of the data bus. The data is transferred to the buffer at step 182. The next address for obtaining the data is read from the table at step 183 and step 184 determines whether the address corresponds with a special number, meaning all data processed for this board. If the answer is No, the program returns to step 178 and reads additional information from RAM 36. When the answer at step 184 is Yes, indicating that data for all the output circuits on the board is available in the buffer, the buffer information is transferred to the output board at step 185. Step 186 determines whether output data has been transmitted to all output boards. If it has not, the board pointer is incremented and the buffer is cleared at step 187. The program then returns to step 177, determining the address for the next bit of information from the table. When all data has been transferred to the last output board, the program exits to the Service routine at terminal 188.

SERVICE

Figure 13:
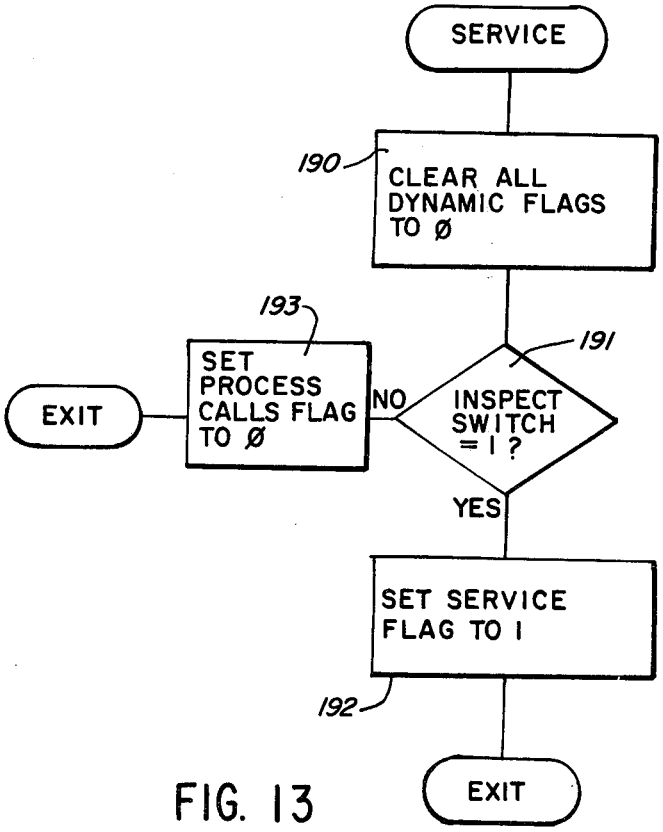

The Service routine illustrated in FIG. 13 clears dynamic flags in RAM 36 that must be renewed, if appropriate, on each execution of the program. In step 180, the dynamic flags are cleared to 0. These include the Process Calls flag, Cancel Calls flag, Service flag, Control Calls flag, and Emergency Service Output flag. The routine then checks the serviceman's Inspect switch at step 191. If the switch is not set for Inspect operation, the Service flag is set to 1 at step 192 and the routine exits. If the switch has been actuated for an inspection, Process Calls flag is set to 0 at step 193 and the program exits.

POSITION

Figure 14:
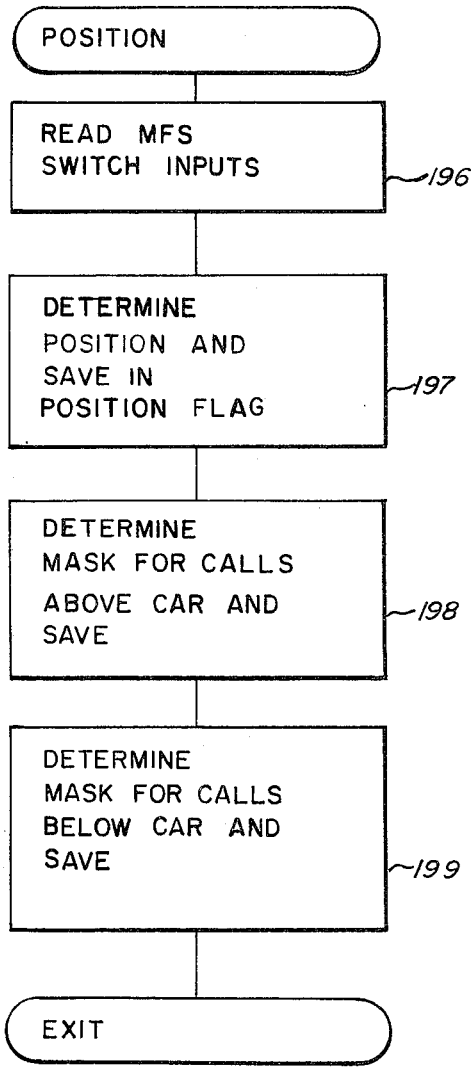

Position routine of FIG. 14 reads the input information from sensor switches 50-2, 50-3 and 50-4, FIG. 3, in step 196. At step 197, the routine determines from the switch inputs the position of the car, and stores this information in RAM 36 at the Position flag address. The routine further establishes data masks for calls above and below the car and saves the mask information, steps 198 and 199.

STOP SWITCH/PROTECTIVE TIMER

Figure 15:
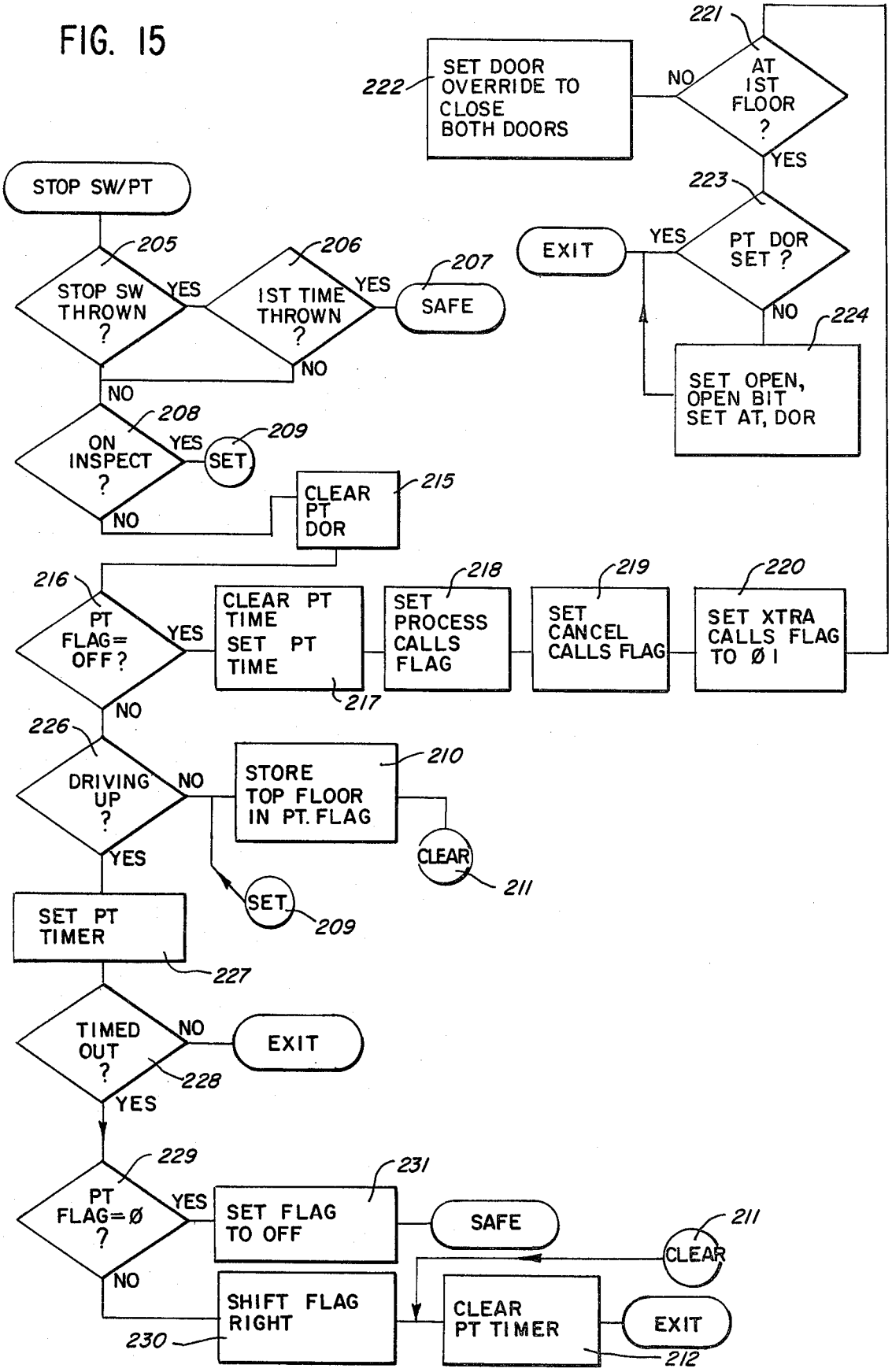

FIG. 15 illustrates a routine for checking both the manually operated Stop switch 59 and a protective timer (PT) for the hydraulic drive and for shutting down the drive if that action is required. The protective timer is one of several timers that may be located in the I/O 34. Step 205 checks whether the Stop switch has been thrown to the stop position; step 206 determines whether this is the first time that the routine has found the switch thrown. If the answer is Yes, a Safe routine is initiated through terminal 207 which shuts down the hydraulic drive. The Safe routine need be initiated only once. If the Stop switch is not thrown or on successive passes following initiation of the Safe routine, the program continues to step 208 which checks whether the Inspect switch has been thrown. If it has, the program continues through Set terminal 209 to step 210 in which a number corresponding to the top floor position in the building is stored in the Protective Timer flag, and through Clear terminal 211 where the Protective Timer is cleared at step 212 and exits the program. Information needed for operation of the Protective Timer when the inspection is finished is retained in the memory. If step 208 determines that the Inspect switch is not thrown, the Protective Timer door override flag which interlocks with the Door Operator routine, is cleared at step 215. The Protective Timer flag is then checked at step 216. If the flag is set to hexadecimal number 'FF', corresponding to all bits set to 1, indicating a malfunction as low oil in the hydraulic system, the Protective Timer is cleared and reset at step 217. Then the Process calls and Cancel calls flags are set at steps 218, 219, so that additional calls are not accepted and registered calls are canceled. Step 220 sets an Extra call flag to return the car to the first floor. Step 221 checks whether the car is at the first floor. If it is not, step 222 provides for an override of the Door Control and closes the car door. When the car arrives at the first floor, step 223 determines whether the Protective Timer door override has been set. If it has not, step 224 sets the door drive flag and sets the Protective Timer door override. The routine then exits.

Returning to step 216, if the Protective Timer flag is not set to hexadecimal 'FF', step 226 determines whether the hydraulic system is driving up. If it is not, there is no need for the Protective Timer, and the routine proceeds through steps 210 and 212, described above, to exit. If the system is driving up the Protective Timer is set at step 227. If the Timer has not timed out, the routine exits at step 228. If the Timer has timed out, step 229 determines whether the Protective Timer flag is at 0. If it is not, the flag is shifted one register space to the right at step 230. The Protective Timer is then cleared at step 212 and the routine exits. The Protective Timer flag is initially set at a position representing the top floor. The timing increment represents the time required for the elevator car to travel up one floor. The Protective Timer is reset and repeatedly times out until the car reaches the floor to which it is directed, or until the flag is shifted to 0 whereupon the PT flag is set to hexadecimal 'FF', step 231, and the Safe routine is initiated.

DRIVE INITIATE

Figure 16:
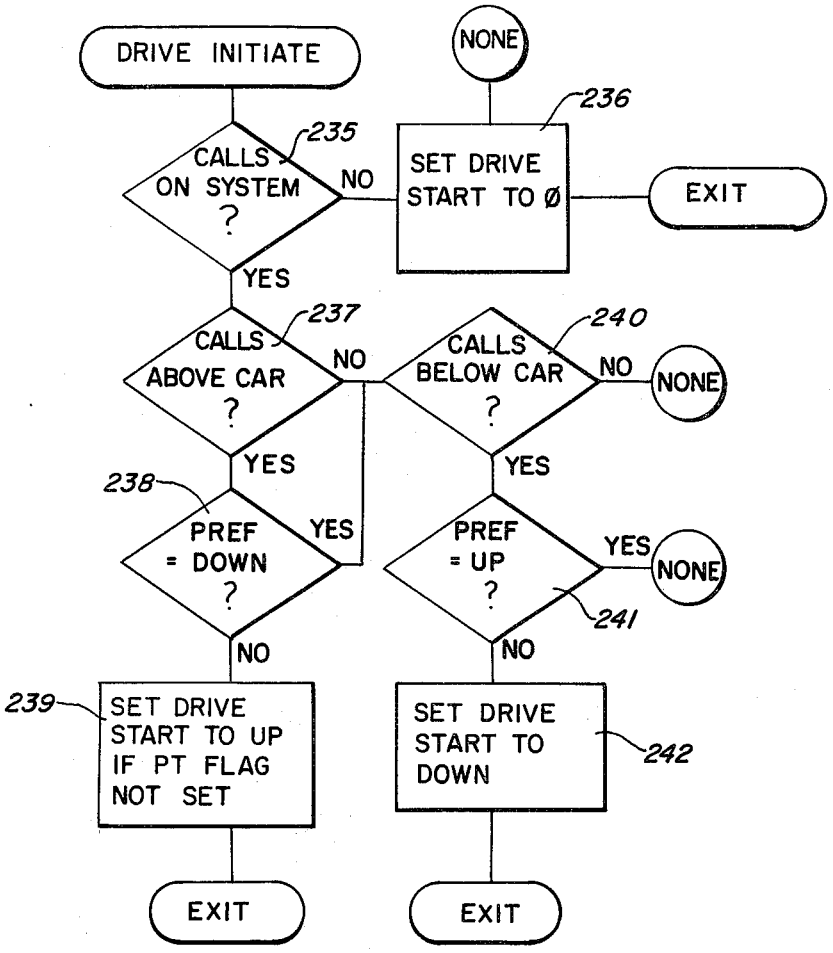

The Drive Initiate routine is shown in FIG. 16. Step 235 checks whether there is a call car service registered. If there is no call, step 236 sets the Drive Start flag to 0 and the routine exits. If one or more calls exist, the routine establishes a Drive Demand. Step 237 checks for calls above the car. If such a call exists, step 238 checks whether a Down Drive preference has been established. If it has not, step 239 sets the Drive Start to Up provided that the Protective Timer flag is not set. The routine then exits. If there is no call above the car or if a Down Drive preference has been established, step 240 checks for calls below the car. If there is no such call, the Drive Start is set to 0 at 236 and the program exits. If a call below the car is registered, step 241 determines whether a drive preference has been established. If it has, the program again returns to step 236, setting the Drive Start to 0, and the routine exits. If an Up preference has not been established with a call registered below the car, step 242 sets the Drive Start flag to Down.

PREFERENCE

Figure 17:
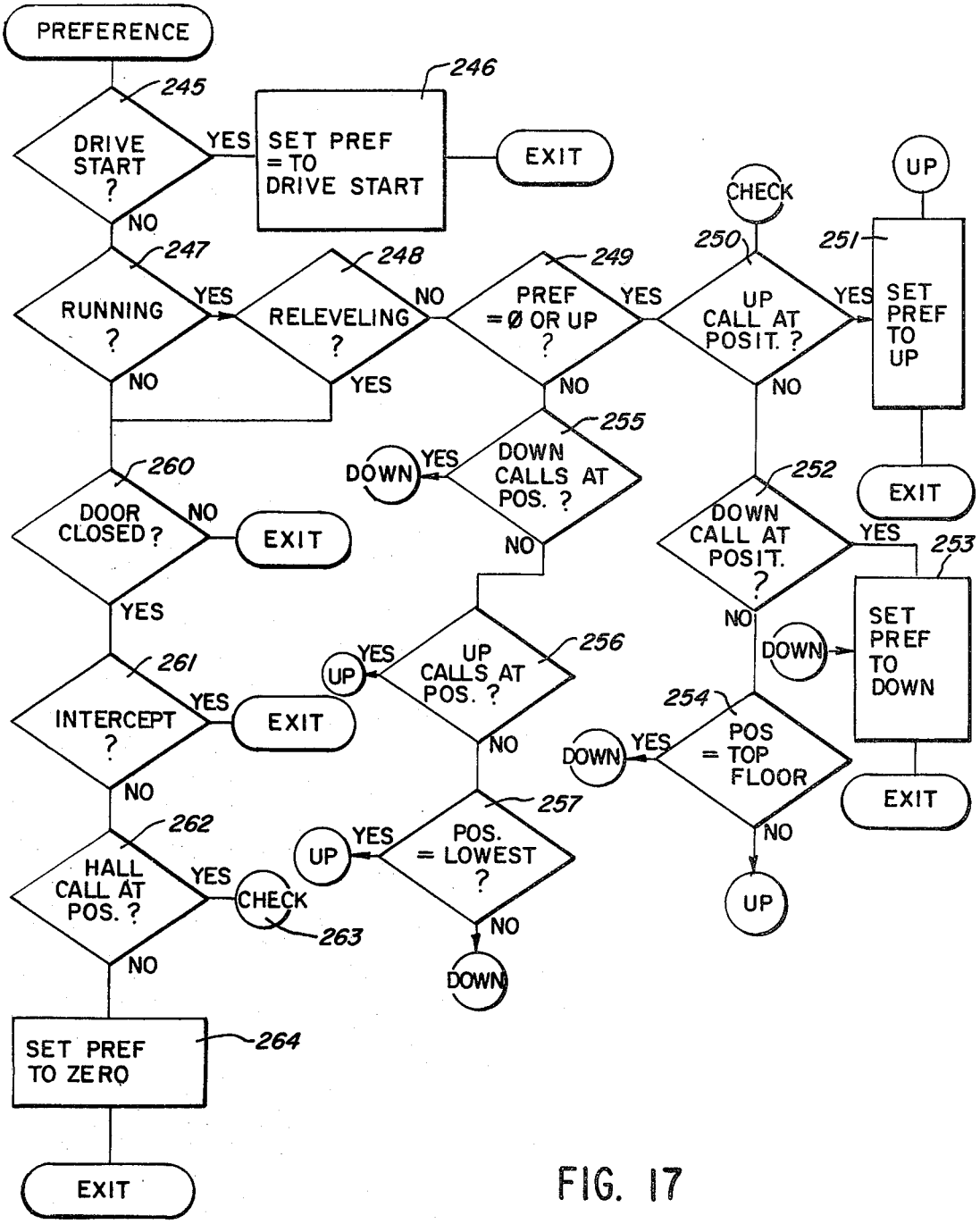

The Preference routine of FIG. 17 establishes a directional preference signal based on registered service calls, from time to time as the elevator operates, as contrasted with the Drive Initiate routine which starts the drive in either the Up or Down direction when a call is registered and the car is not running. Step 245 determines whether the Drive Start flag (FIG. 16) is set. If it is, step 246 establishes the directional preference as that of the Drive Start, and the routine exits. If the Drive Start flag is not set, steps 247 and 248 determine whether the car is running or releveling at a floor. If it is not, step 249 checks whether the directional preference for the car is either 0 or Up. If the answer is Yes, step 250 determines whether there is an Up call at the car position. If there is, step 251 sets a Preference flag to Up and the routine exits. If there is not an Up call at the car position, steps 252 checks for a Down call. If there is such a call, step 253 sets the flag for Down Preference and the routine exits. If there is no Down call at the car position, step 254 checks the car position to determine whether it is at the top floor of the structure. If it is not, the routine returns to step 251 and sets the Up preference flag. If the car is at the top floor, the routine proceeds to step 253 and sets the Down preference flag. If at step 249 the preference is neither 0 nor Up, step 255 checks whether there is a Down call at the car position. If there is, the Down Preference flag is set, step 253. If there is no Down call, step 256 checks for an Up call at the car position. If there is an Up call, the Up Preference flag is set at step 251. If there is no Up call at the car position, step 257 determines whether the car is at the lowest floor of the structure. If it is, the Up Preference flag is set, if it is not, the Down Preference flag is set.

Returning to steps 247, 248, if the car is not running or if it is releveling, step 260 checks whether the car door interlock (CG) indicates that the car door is closed. If the door is not closed, the routine exits. If the door is closed, step 261 checks the Intercept flag which is set when there is a need to stop at an approaching floor and is cleared upon stopping at the floor. If the Intercept flag is set (as when the car is releveling), the routine exits. If the Intercept flag is not set, step 262 checks for a Hall call at the car position. If a Hall call exists, the routine proceeds through check terminal 263 to step 250, 252 to determine whether there is an Up or Down call at the car position. If there is no Hall call, Preference is set to 0, step 264, and the routine exits.

DOOR OPERATOR

Figure 18A:
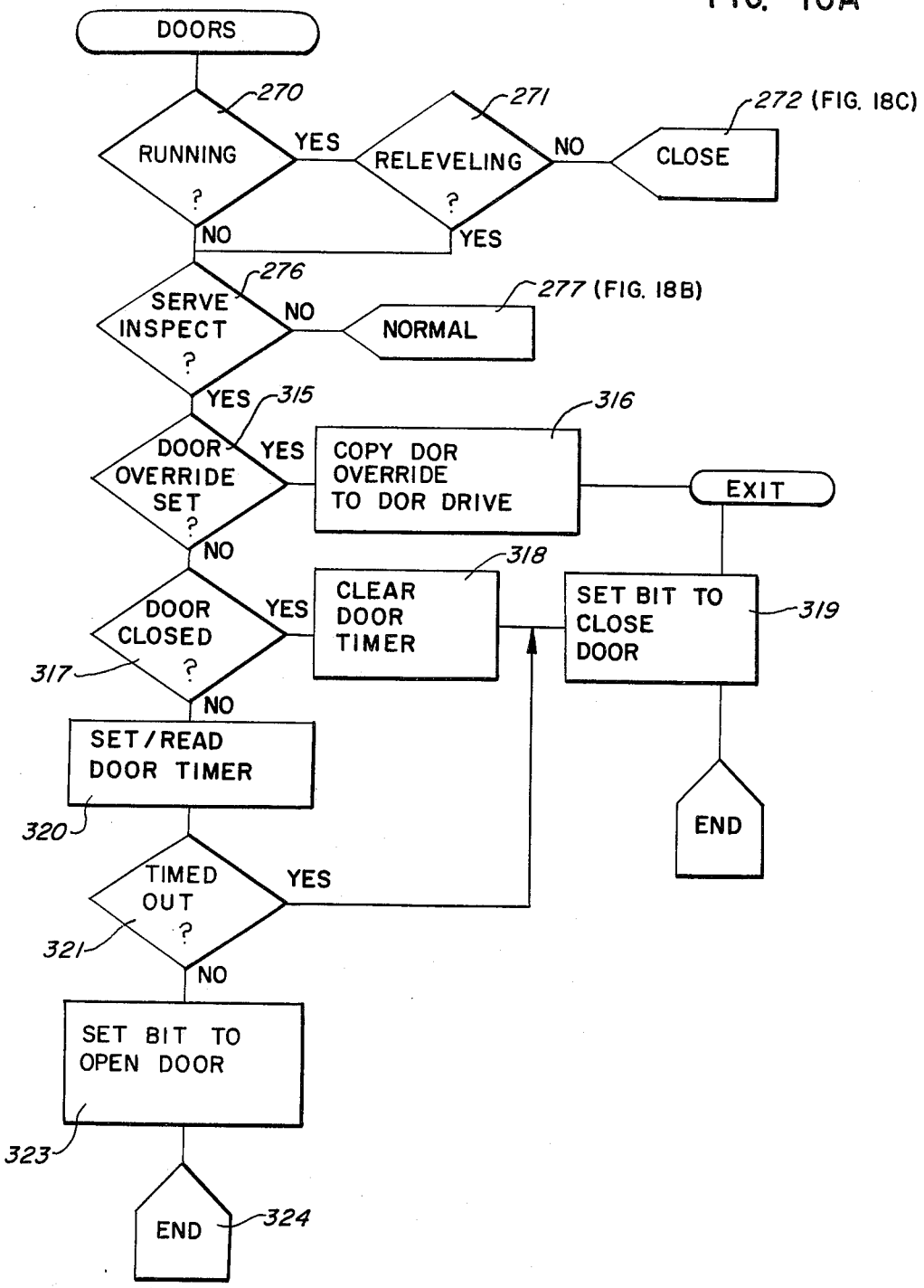
Figure 18B:
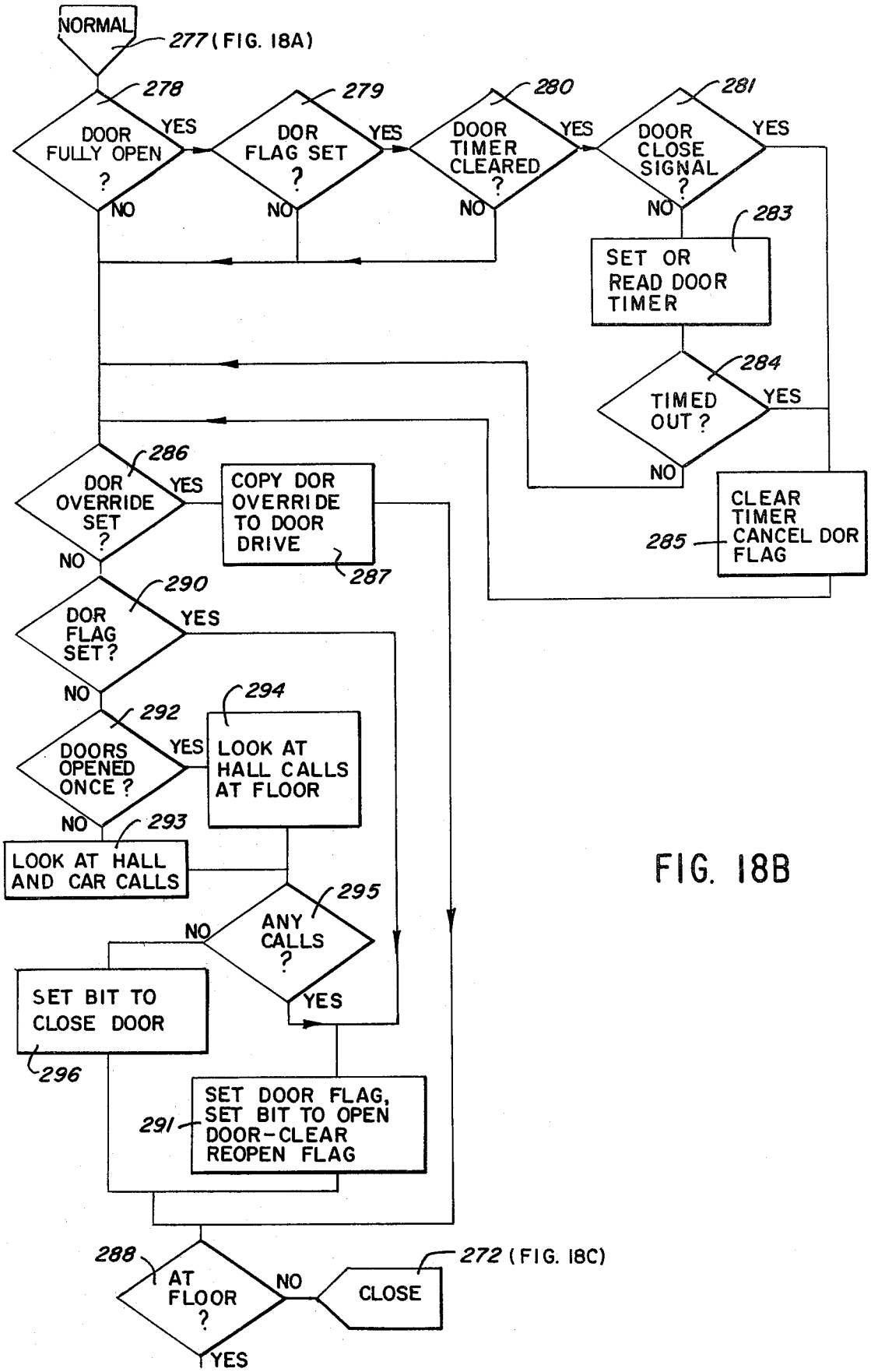
Figure 18C:
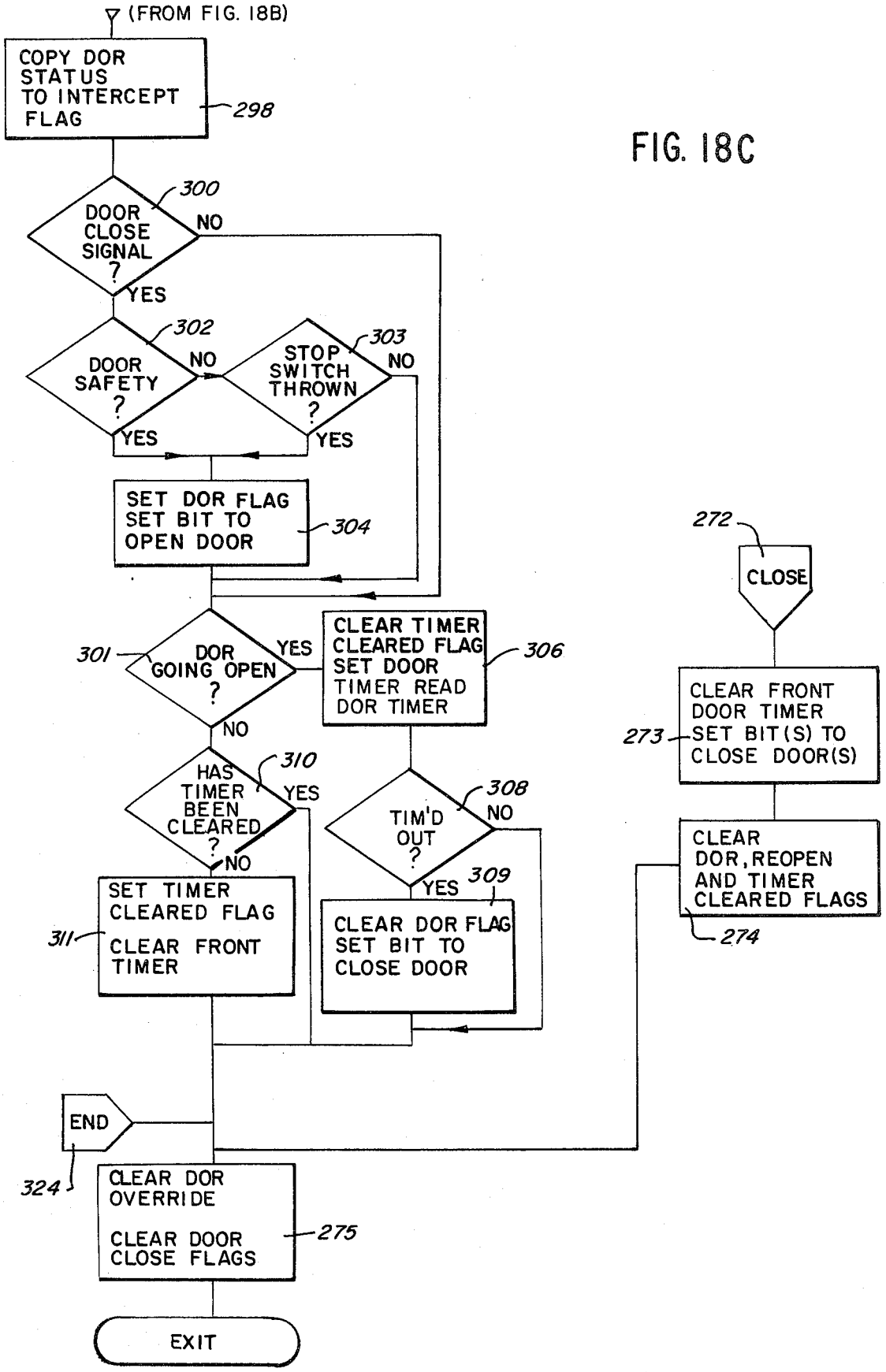

FIG. 18A illustrates with a simplified flow chart the routine for operating the elevator doors. Step 270 determines whether the car is running. If it is running, step 271 determines whether it is releveling. If the answer is No, the program jumps via close connector 272 to step 273 (FIG. 18C), clearing the Front Door timer and setting a bit to close the door. At step 274, Door Open, Reopen and Timer flags are cleared. At step 275, Door Open Override and Door Close flags are cleared and the routine exits.

Returning to FIG. 18A, if the car is not running or is releveling, step 276 checks whether the Inspect switch is actuated. If it is not, the routine enters by way of terminal 277, the program for normal door operation, FIG. 18B. Step 278 determines whether the door is fully opened. If it is, various inquiries are made regarding the Door Open flag, Door Timer and Door Close signal.

Step 279 checks for the Door Open flag, and if it is set, step 280 determines whether the Door Timer is cleared, and if it is, step 281 checks the door drive flag for a Door Close signal. In the presence of a Door Close signal, step 282 clears the Timer and cancels the Door Open flag. If there is no Door Close signal, step 283 sets the Timer if it is not set or reads the Timer if it is set. At step 284, if the Timer is timed out, the routine proceeds to step 282 clearing the Timer and canceling the Door flag.

In the event any of the inquiries 278, 279, 280 or 284 yield a No answer or upon completion of step 282, the routine proceeds to step 286 to determine whether a Door Override is set. This might be established by the Door Open button on the car or by actuation of a door safety. If the Door Override is set, step 287 copies this information to the Door Drive Flag and the routine proceeds to step 288, checking whether the car is at a floor. If it is not (indicating that the car may be stopped at an intermediate point in the hatchway), the program exits via Close terminal 272, described above.

Returning to step 286, if the Door Override is not set, step 290 checks whether the Door Open flag is set. If it is, the program proceeds to step 291 which continues the status of the Door Open flag, sets the bit in the door drive flag to open the door, and clears the Door Reopen flag. If the Door Open flag was not set at step 290, step 292 determines whether the doors have previously been opened. If they have not, step 293 looks at all calls in the direction of travel preference and at Car Calls for the floor where the car is stopped. If the doors have already opened once, step 294 looks only at Hall calls at the floor in the direction of preference. Thus, the system allows exiting passengers ample time to leave the car, but provides additional time for intending passengers at the floor to enter the car. Step 295 determines whether there are registered calls which meet the criteria of steps 293, 294. In the absence of calls, step 296 sets a bit in the door drive flag to close the door. In the presence of a call, the routine proceeds with step 291 setting a bit to open the door and continues to step 288, described above.

If the car is located at a floor, the routine continues with step 298 (FIG. 18C) copying the Door Open status flag to the Intercept flag. Step 300 then determines whether there is a Door Close signal. If there is not, the routine continues with step 301, below. If there is a Door Close signal, steps 302 and 303 check the door safeties (e.g., a light beam and photocell in the doorway or door edge switch) and the Stop switch, and if either inquiry is positive, step 304 sets the Door Open flag and a bit in the door drive flag to open the door, and the routine proceeds to step 301. If the inquiries at steps 302 and 303 are both negative, the routine proceeds to step 301.

Step 301 determines whether the door is in the process of opening. If it is, step 306 clears the Door Timer Cleared flag, sets the Door Operator timer, or it if is already set, reads the timer. Step 308 determines whether the timer has timed out and if it has, step 309 clears the Door Open flag and sets a bit to close the door. The routine ends with step 275 discussed above. If the timer has not timed out, the routine proceeds from step 308 to final step 275.

At step 301, in the event the door is not going open, step 310 checks whether the timer has been cleared. If it has, the routine proceeds to final step 275. If it has not, the Timer Cleared flag is set, the timer is cleared at step 311, and the routine proceeds to step 275.

Returning to FIG. 18A, if the system is conditioned for Inspection, the routine continues from step 276 to step 315 which inquires whether the Door Operator Override is set. If it is, step 316 copies this information to the Door Operator Drive flag and the routine exits. If the Override is not set, step 317 determines whether the door is closed. If it is, step 318 clears the Door Timer, step 319 sets the Closed Door bit in the door drive flag, and the routine exits. If the door is not closed, step 320 sets and reads the Door Timer. At step 321, if the timer is timed out, the routine returns to step 319. If the timer is not timed out, step 323 sets the bit to open the door and the routine proceeds through End terminal 324 to step 275 described above.

INTERCEPT

Figure 19:
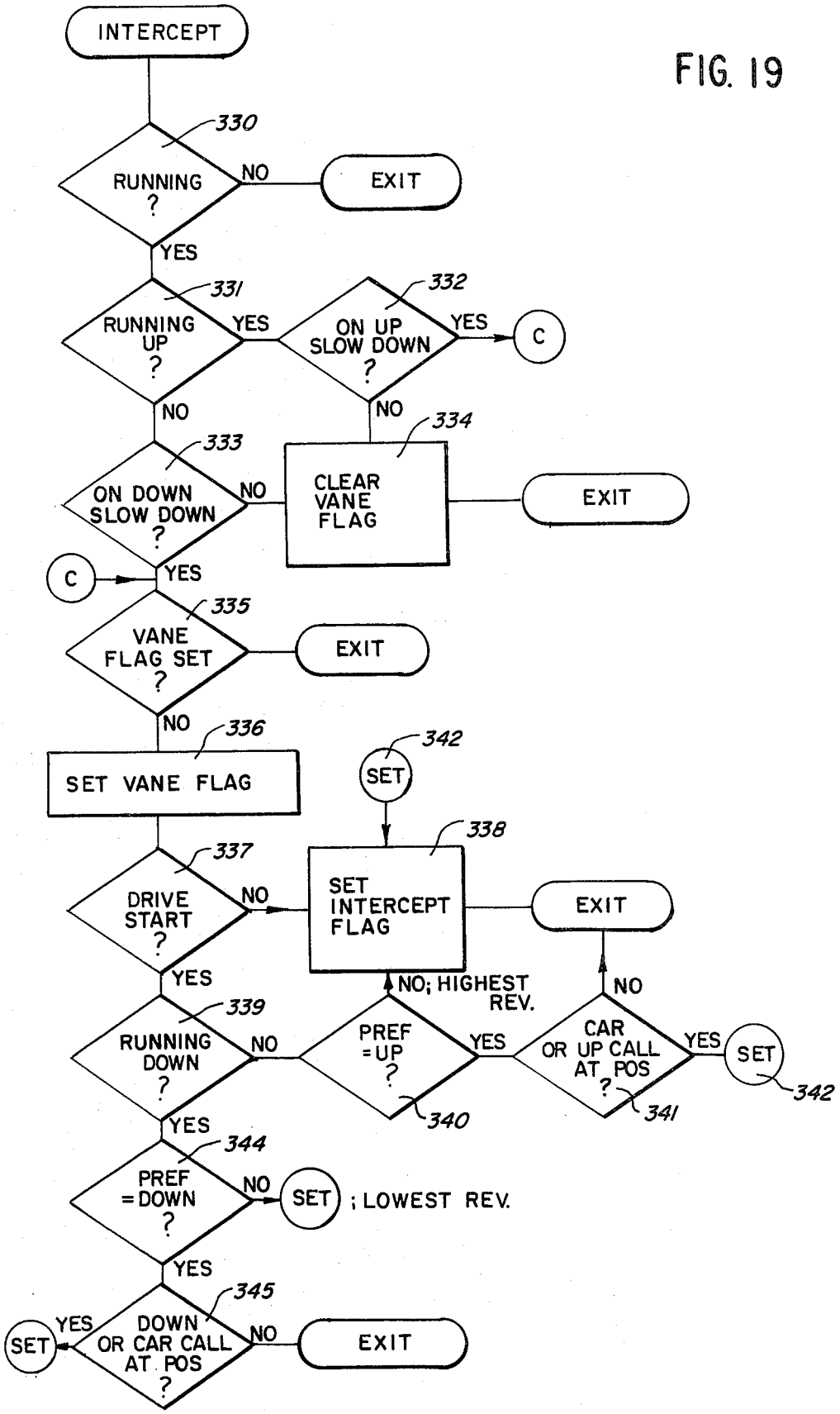

The Intercept routine of FIG. 19 correlates the car position and registered calls and determines whether the car should decelerate and stop at a floor which is being approached. Use is made of information from the Car Position sensors and from the Up and Down Intercept sensors 52, 53, FIG. 3, which detect car position with respect to the leveling vanes 51-1–51-4. Step 330 determines whether the car is running and if it is not, the routine exits. If it is running, step 331 determines the direction and steps 332, 333 determine whether the car is in a position for slowdown, i.e., with the Up or Down Intercept sensors detecting a vane. If the answer is No, step 334 clears the Vane flag and the routine exits. If either step 332 or 333 indicates that the car is sensing a vane, the routine proceeds to step 335 which determines whether a vane flag has already been set. If it has, the routine exits. If it has now, step 336 sets the flag. Step 337 checks the Drive Start flag which indicates whether there is a drive demand on the system. If there is not, indicating that all calls on the system have been canceled, step 338 sets the Intercept flag. As will appear, setting the Intercept flag causes the drive to decelerate in preparation for stopping. With the Intercept flag set, the routine exits. If the inquiry at step 337 is affirmative, step 339 determines the direction of car movement. If the car is traveling up, step 340 determines whether this is the preferred direction. If it is not, the car should reverse and the Intercept flag is set at step 338. If up is preferred, step 341 determines whether there is an Up call requiring a stop at the floor which the car is approaching. If there is not, the routine exits. If there is, a signal through terminal 342 sets the Intercept flag at step 338. A similar procedure is followed if the car is traveling down. Step 344 checks preference and step 345 determines whether there is a call to be answered.

CANCEL CALLS

Figure 20:
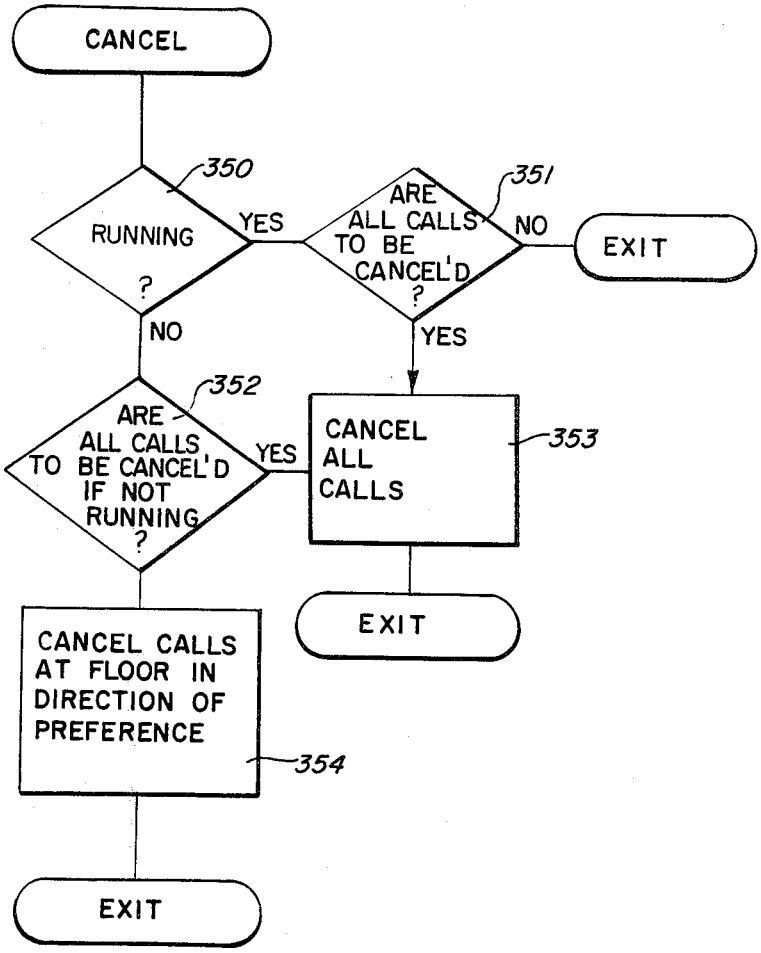

The routine for canceling answered calls is illustrated in FIG. 20. Step 350 determines whether the car is running. If it is, step 351 determines whether all calls are to be canceled as in the case of the Inspect or Emergency service. If the calls are not to be canceled, the routine exits. If the car is not running, step 352 makes a similar inquiry regarding cancellation of all calls. If either step 351 or 352 has an affirmative answer, step 353 cancels all calls and the routine exits. If all calls are not to be canceled, and the car is not running, 354 cancels those calls for car service at the floor where the car is located and for hall calls in the direction of car travel preference.

DRIVE ROUTINES

The drive program illustrated in FIGS. 21A thru 21F is for a hydraulic elevator with a three phase motor having a Y-Δ configuration transition for starting. The system has high and low operating speeds and provides for leveling the car at an intended landing.

The Drive program utilizes a Drive Pointer with five conditions which determine the portion of the program sequence to be performed. The Drive Pointer conditions are:

1. Power on (POWRON), in which power is applied to the three phase motor that drives the hydraulic pump.
2. Check start (CHKST) in which a Y-Δ timer controls the transition to full speed operation and the control is conditioned for stopping at a landing.
3. Retard, in which the car is decelerated on approaching an intended landing.
4. Level in (LEVIN), in which the leveling of the car at a landing is carried out.
5. Shut down (SHUTDN) in which the motor is turned off.

Figure 21A:
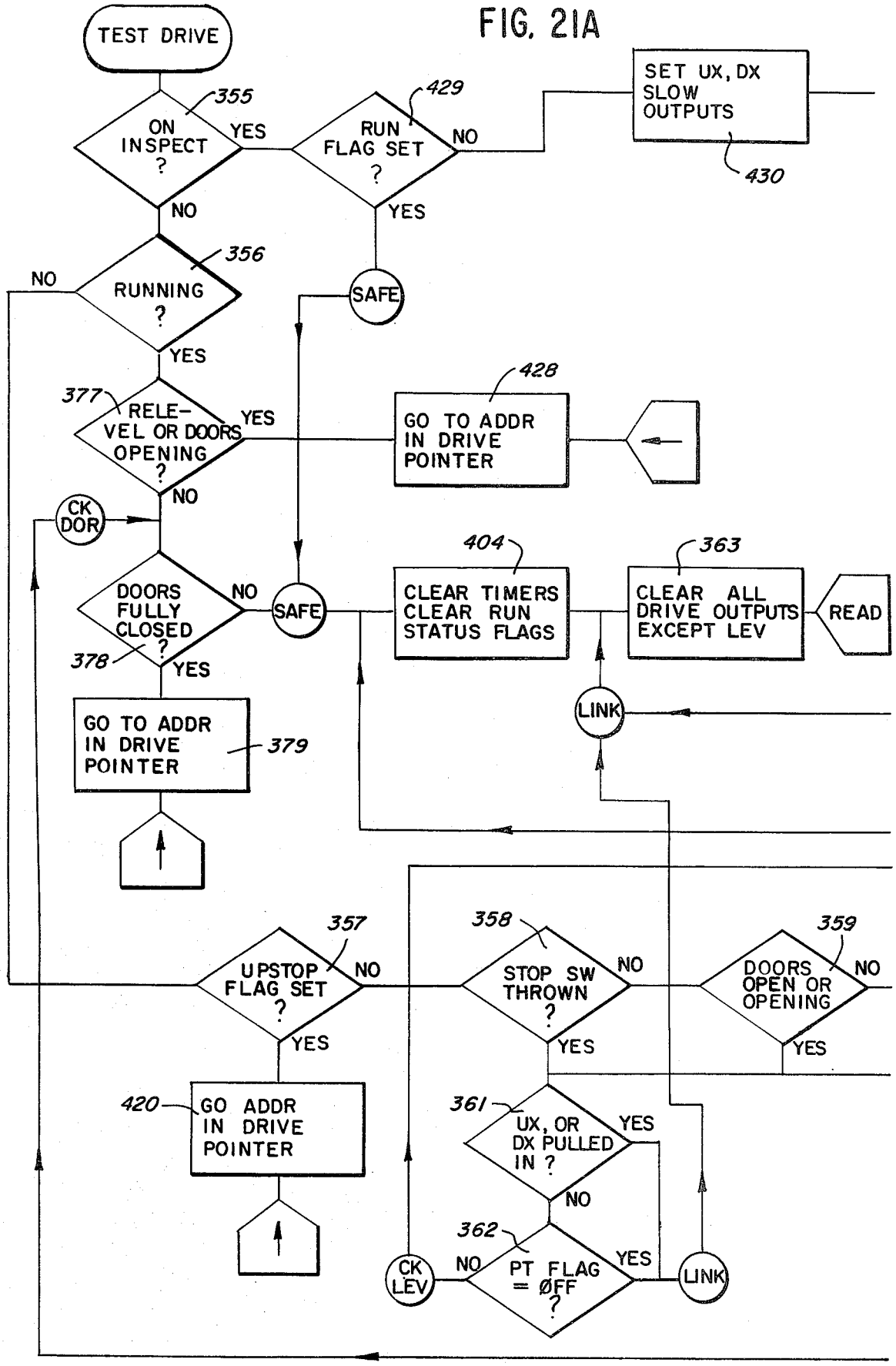
Figure 21B:
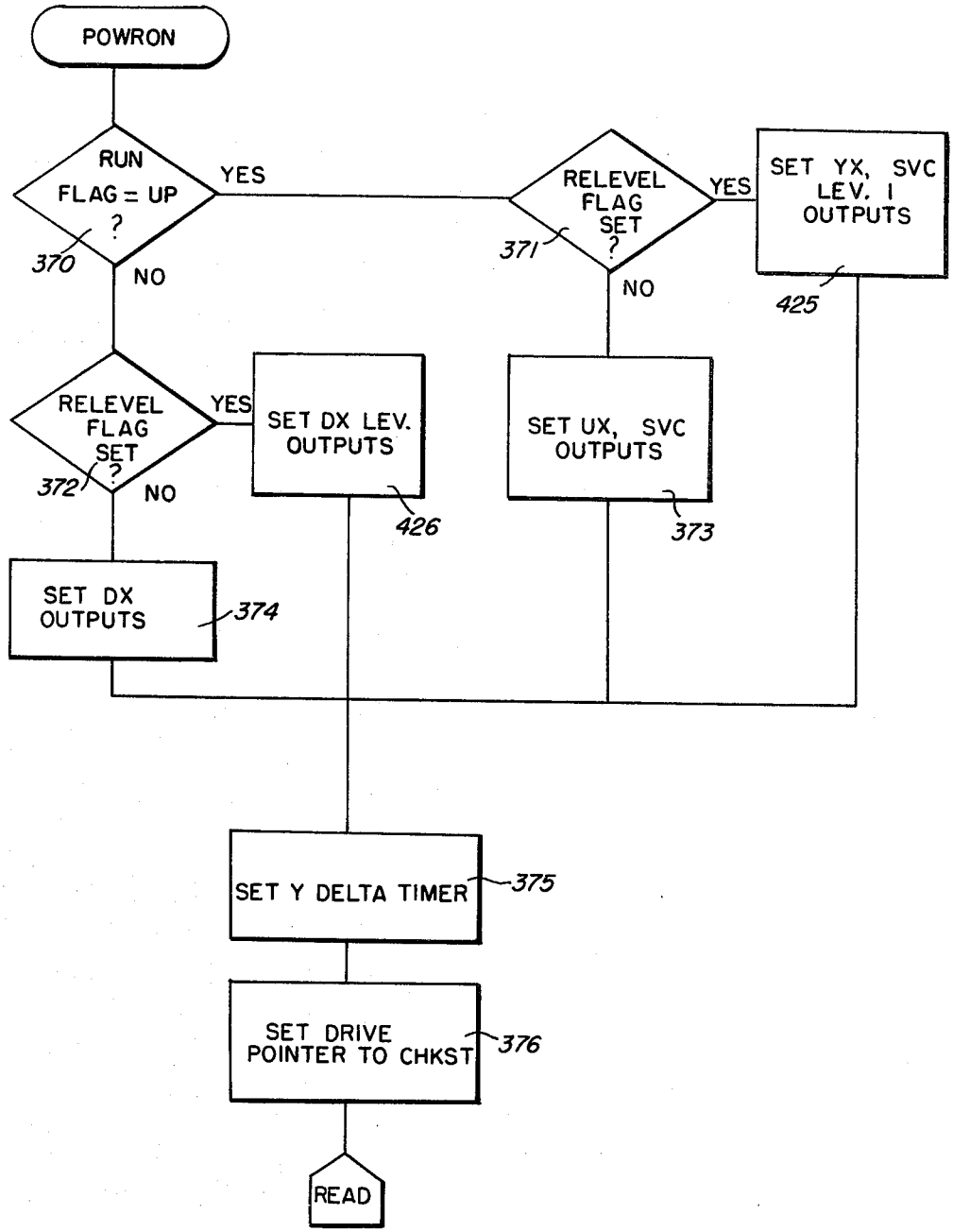

The Drive routine 128, FIG. 6, on each performance of the control program starts with the test drive program of FIG. 21A. Assume that the car is not running and that there is no demand for service, the program checks first for Inspection service at step 355, and then at step 356 whether the car is running. With the car not running, step 357 determines whether the Up-Stop flag is set. The program then determines at 358 whether the stop switch is thrown and at 359 whether the doors are open or opening. Next, step 360 determines whether a Drive Start condition exists. In its absence step 361 checks whether the up or down direction relay (UX or DX) is pulled in. With no call for service neither relay is actuated. Then, step 362 determines if the protective timer flag is set to hexadecimal 'FF'. The program continues through the LINK terminals to step 363 where Drive output flag bits (except LEV) are cleared and the program exits to the READ routine, step 116, FIG. 6.

On the next performance of the Drive Routine, assume that a call has been registered. Step 360 determines that a drive start signal exists. Step 364 checks for direction and sets either the Up or Down run flag, steps 365, 366. Step 367 sets the Drive Pointer to POWRON. Step 368 checks for the Relevel Flag which is not set during initiation of operation. Then step 369 directs that the routine go to the address of the Drive Pointer, see FIG. 21B.

Direction is checked at step 370. Steps 371, 372 determine whether the system is releveling or preparing to run. Assuming that the car is preparing to run, steps 373, 374 set the appropriate direction output bits in the drive output Flag. If the car is to travel up, step 373 also sets an SVC output which holds the car motionless while the motor comes up to speed. The Y-Δ transition timer is set at step 375 and the Drive Pointer shifted to CHKST at step 376. The routine then exits to the READ routine.

On the following performance of the program, step 356, FIG. 21A, determines that the car is running. Step 377 checks whether Releveling is going on or the doors are opening. In the absence of these conditions, step 378 determines whether the doors are fully closed. Assuming that they are, step 379 directs the routine to the next address of the Drive Pointer, the Check Start routine, FIG. 21C.

Step 380 determines direction and steps 381, 382 and 383 determine whether the direction relays UX, DX are pulled in. If one is, step 384 determines whether the car is to travel up or down. If it is to travel up, step 385 checks whether Y-transition has occurred. If it has not, the program returns to the POWRON routine, FIG. 21B. If the transition has occurred, step 386 clears the Y- timer and step 387 determines whether the car is leveling. If it is not, step 388 determines direction and sets the appropriate direction and speed outputs at steps 389, 390. Step 391 sets the Drive Pointer to Retard and the program exits to the READ routine.

At step 383, if neither direction relay UX or DX is pulled in, step 383A reads the Y-Delta timer. At step 383B if the timer is timed out, the routine exits to the safe terminal, FIG. 21A. If the timer has not timed out, the routine returns to the POWRON sequence, FIG. 21B.

On the next performance of the Drive program, the routine goes from step 379, FIG. 21A, to the Retard routine, FIG. 21D. So long as the floor intercept is not set at step 392, the program returns through Fast terminal to step 388, FIG. 21C. When the Intercept Flag is set, as occurs when the car must slow down to stop at a floor, the program continues through Slow terminal to step 393, FIG. 21C, which determines direction and sets the appropriate leveling and direction outputs at steps 394, 395. Step 396 sets the Drive Pointer to LEVIN and the routine exits to READ.

Figure 21E:
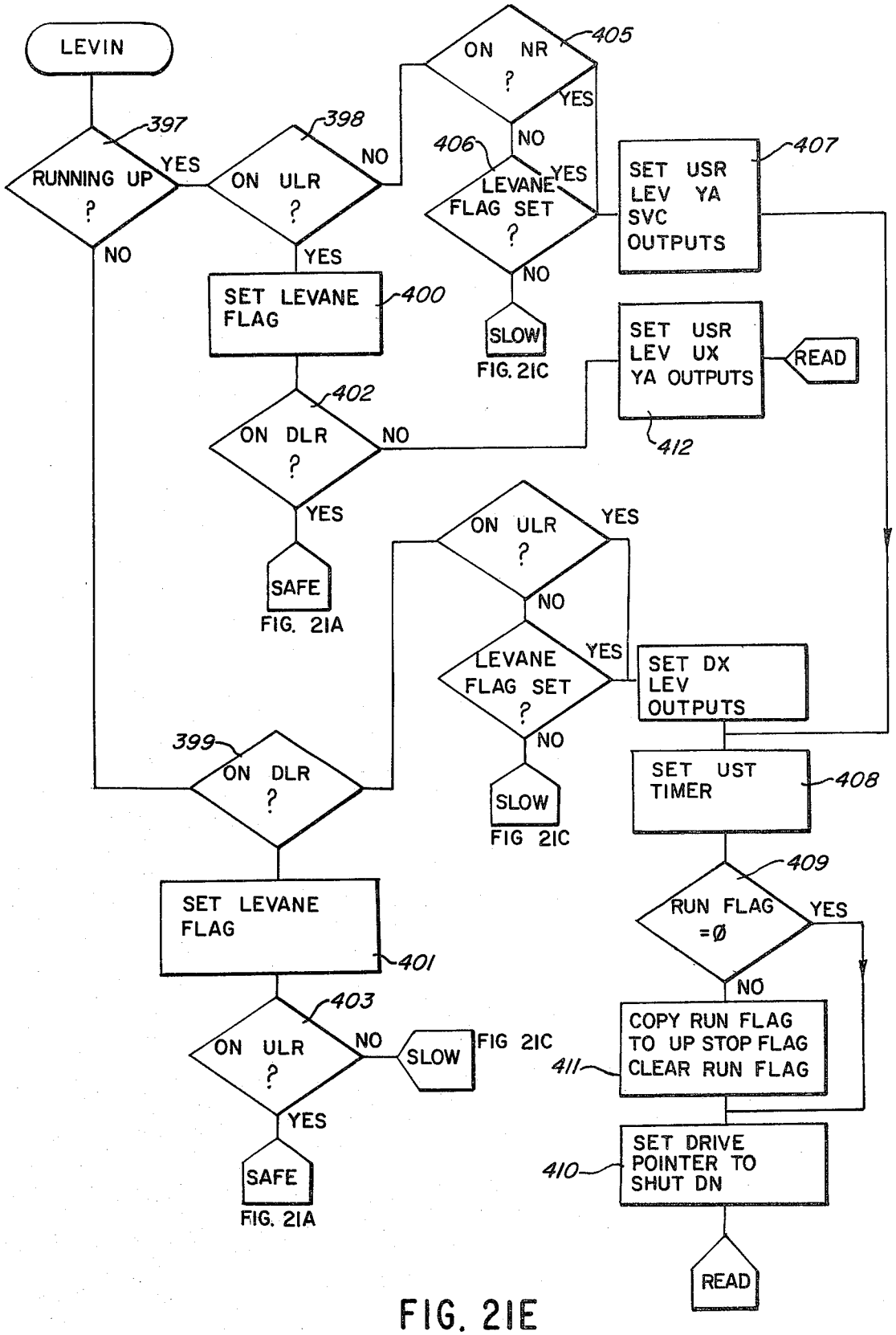

With the next performance of the Drive routine, step 397, FIG. 21A, goes to the LEVIN routine, FIG. 21E. Step 397 determines direction. Steps 398, 399 determine whether the car is on either an up or down leveling Unit 54, ULR, DLR, depending on running direction. Assuming the answer is Yes, Vane Flags are set at 400 or 401. The routine then checks at steps 402, 403 to determine whether both leveling units are actuated. If the answer is yes, the routines continue through Safe terminal to FIG. 21A where step 404 clears all timers and Run Status Flags and then clears the drive output flag, except LEV bit, step 363.

Before the car approaches the intended landing, neither ULR nor DLR will be on. The programs for up and down are analogous and only one will be described. With the car running Up and not at the Up level unit, the program continues from step 398 to step 405 which checks the Down Level unit. If it is not actuated and the Leveling Vane Flag is not set at 406, the routine returns to Slow terminal FIG. 21C and repeats the routine there. If the Down Leveling Unit is on or the Level Vane Flag set, step 407 sets the Up Stop Relay, Leveling, YA and SVC output bits in the drive output flag. Step 408 sets the Up Stop Timer. At step 409 it is determined whether the Run Flag is zero. If it is, step 410 advances the Drive Pointer to SHUTDN and the program exits to READ. If the Run Flag is not zero, which will initially be the case, step 411 copies the Run Flag to the Up Stop Flag and clears the Run flag before the routine proceeds to step 410. A complementary program for Down travel from step 399 to 408 is illustrated in FIG. 21E but will not be described in detail.

If at step 402 it is determined that the Down Level Unit is not on, step 412 sets the indicated output bits and the routine exits to READ. Conversely, if at step 403 it is determined that the Up Level Unit is not on, the program returns to SLOW terminal, FIG. 21C. Similarly, if the Level Vane Flag is not set at step 406, the program returns to the SLOW terminal, FIG. 21C.

Figures 21A, 21F:
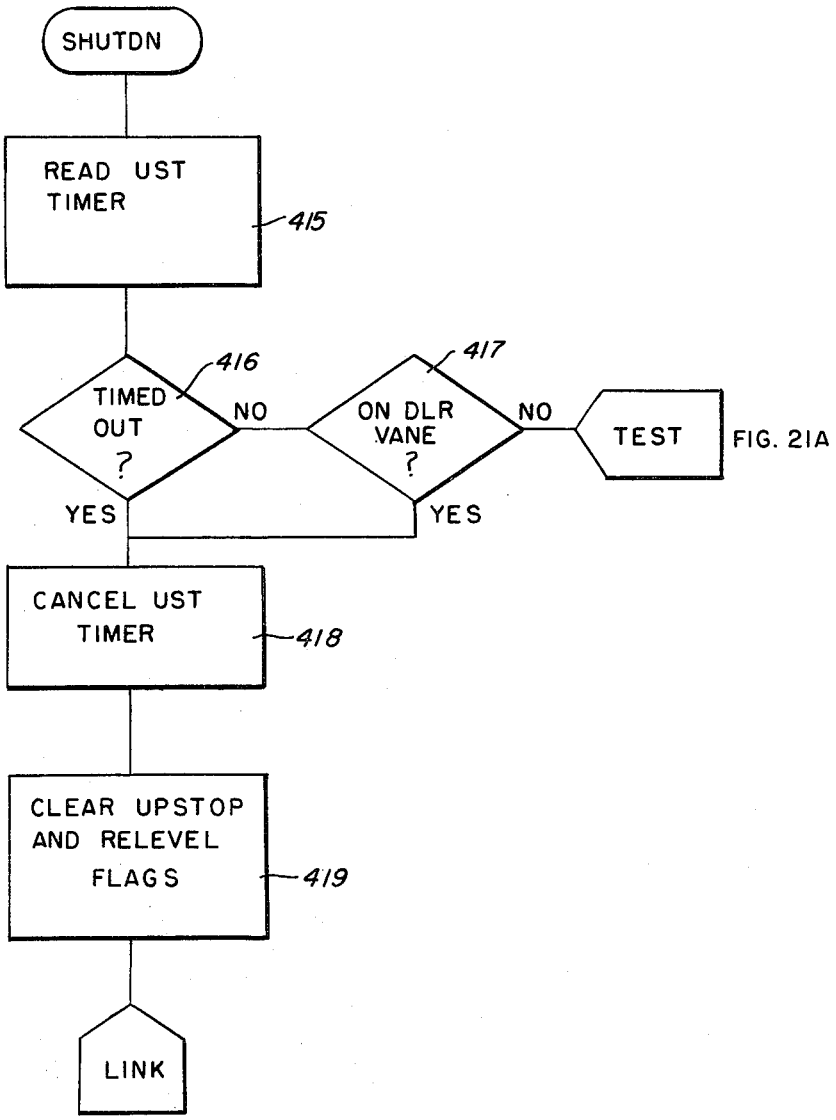

After the Drive Pointer is set to SHUTDN, the next performance of the drive routine proceeds from step 379 to FIG. 21F. Steps 415, 416 read the Up Stop Timer and determine whether it has timed out. If it has timed out or if step 417 determines that the car is on the Down Level Relay Vane, step 418 cancels the Timer, step 419 clears the Up Stop and Revel Flags and the program continues through LINK terminal to step 363, FIG. 21A. If the car is now on the Down Level Relay Vane, the program proceeds through TEST terminal to step 355, FIG. 21A.

There are several aspects of the program illustrated in FIG. 21A which have not yet been described.

It at step 357 with the car not running but the Up Stop Flag is set, step 420 goes to the address of the Drive Pointer. This makes sure that the shut down is properly carried out.

At step 362 with the Protective Timer Flag Not set to hexadecimal 'FF', the routine continues through CKLEV terminal to step 421 checking whether any of the leveling units show a "1" output. If they do not, the routine is connected through the LINK terminal to step 363, described above. If a leveling unit shows an output, the Relevel Flag is set at 422. Step 423 determines whether Leveling should be Up or Down and the appropriate flag is set at steps 365 or 366. If the Stop switch is thrown, step 424 prevents leveling down and goes to steps 404 and 363 to clear timers, Run flags and Drive outputs. The Relevel Flag set at step 422 is checked at step 371, 372 of the POWRON sequence, FIG. 21B, to set appropriate outputs at 425, 426.

If at step 377, in FIG. 21A, the system is either releveling or the doors are opening while the car is running, step 428 directs the routine to the address in the Drive Pointer.

At step 368, during releveling, the routine is connected through the CKDOR terminal to step 378, described above.

Finally, if at step 355 it is determined the system is on Inspect service, step 429 determines whether the Run Flag is set. If it is, the routine proceeds through the Safe terminal to steps 404 and 363. If it is not, step 430 sets the direction and slow speed outputs, direction is checked at step 431 and the Y-Δ timer set or reset at steps 432, 433. Step 434 checks whether the timer has timed out and when it has, sets the Up and Down Directions, Slow and YA outputs at step 435.

Figure 9:
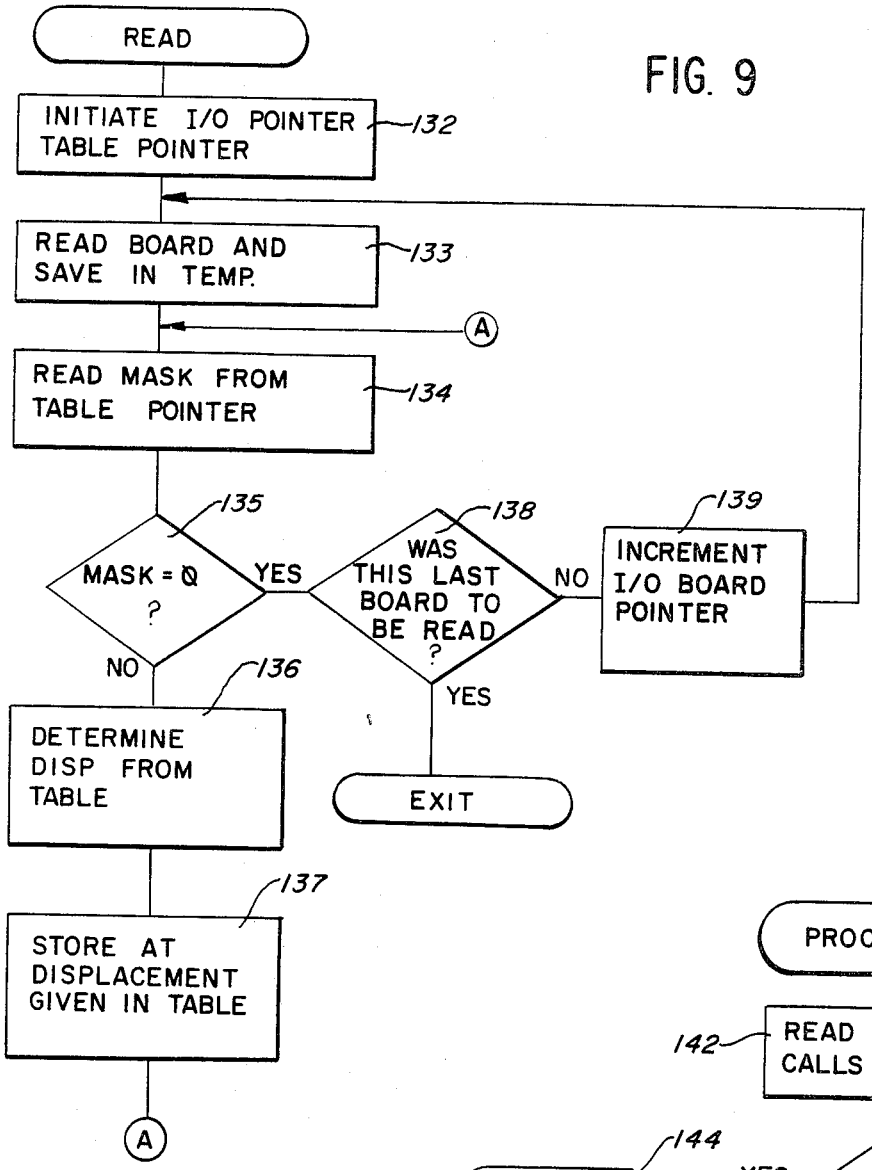

Following completion of the Drive routines, the program returns to the Read routine 116, FIG. 9, and the program sequence is repeated. As mentioned above, the time for completion of the sequence is of the order of 40 miliseconds. Accordingly, any change in condition of the inputs is promptly noted and the system outputs appropriately modified.

Alternate and supplemental routines may readily be incorporated in the program sequence. Some which have been found desirable but which have not been described in detail above, include:

Emergency Service

Inspection

Routines for operating a car with more than one door

A Door operating routine in which the doors begin to open before the car steps at the intended floor. Other functions may be incorporated depending on the nature of the car, the structure and the sophistication of control which is desired.

A major feature of the invention is the ability to assemble a program to control an elevator for a specific structure from a library of standard program blocks or routines. As a part of the assembly procedures, the program blocks are tailored to the elevator car structure parameters.

Figure 22:
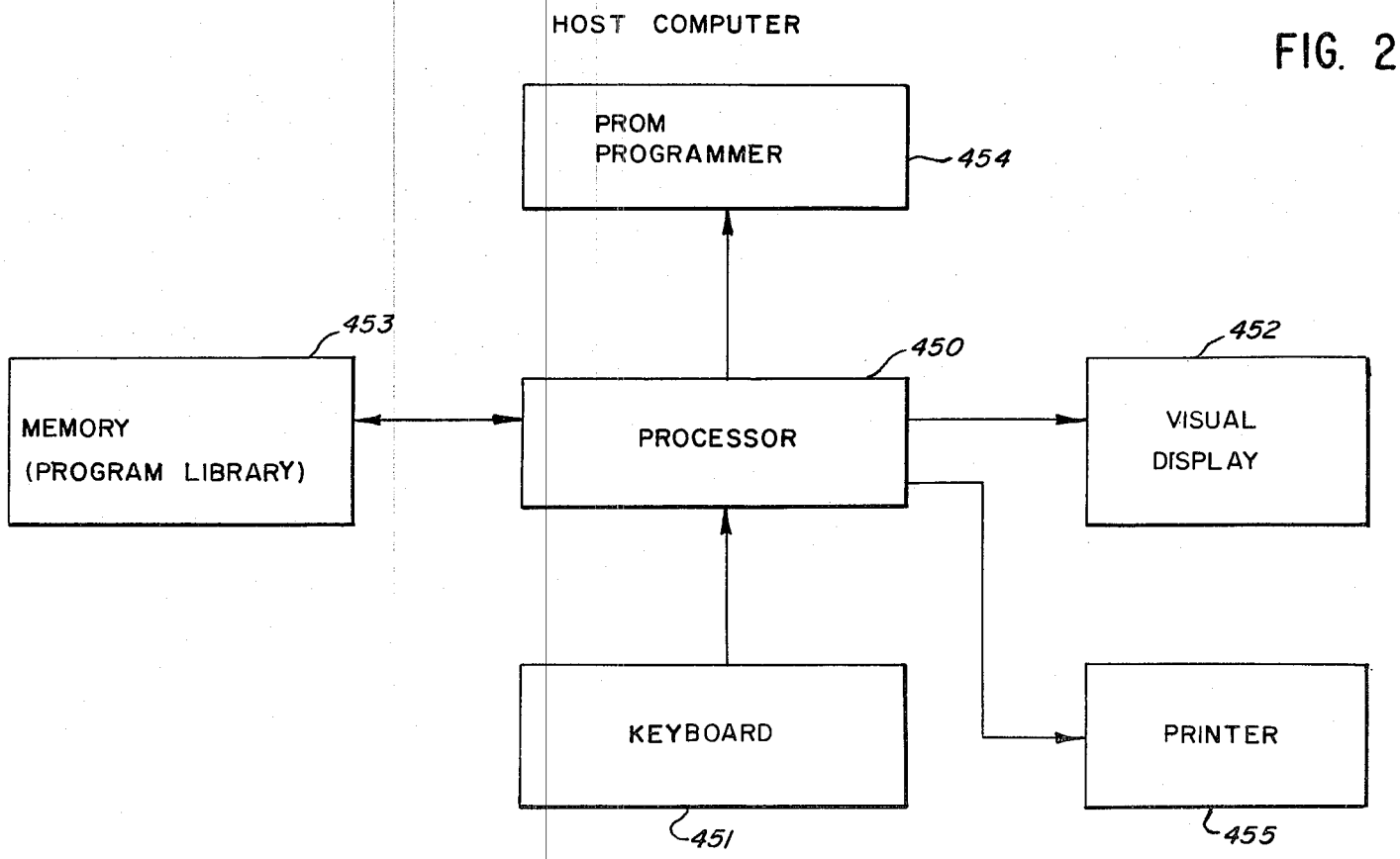
FIG. 22 is a general block diagram of a computer system which may be utilized to generate an elevator control and to program the read only memories therefor.

FIG. 22 illustrates in block form a host computer apparatus which may be utilized in the assembly of the program. A processor 450 has a keyboard 451 through which information concerning the elevator installation is provided by an operator. A visual display 452 facilitates verification of the information as it is provided through the keyboard and is used to prompt the operator with respect to the information needed. Memory 453 contains a library of program blocks of routines which may be selected by the processor in building up the control. A PROM programer 454 is connected with the processor so that the PROM 35 can be programed directly as a part of the system control development. Printer 455 provides for hard copy of the system description and parameters including I/O board complement, terminal wiring instructions, electrical and hardware requirements and a step by step analysis of the various program routines.

Figure 23:
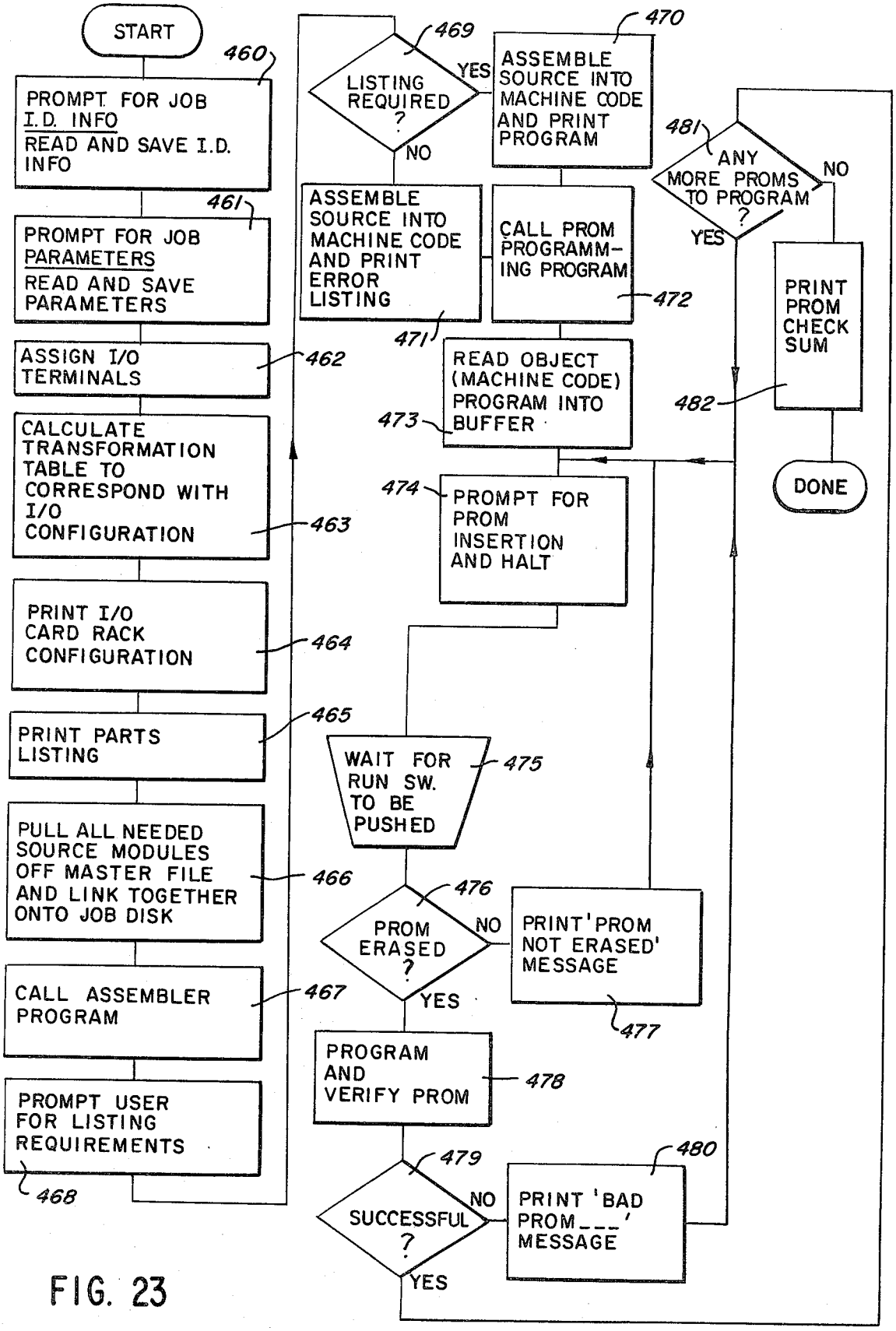
FIG. 23 is a simplified flow chart for the control generating computer system.

The operation of the host computer will further be described in connection with the simplified flowchart of FIG. 23. At step 460, processor 450, through visual display 452 asks the operator for job identification information. This might include, for example, the name and address of the structure and the number or other identification for the elevator. As the information is recorded through keyboard 451, it appears on the visual display 452 so that the operator can verify its accuracy. When it is complete and accurate the operator directs the processor to read the information and to save it. In step 461, the processor asks for the job parameters. As in step 460, the information is supplied through keyboard 451 and is presented for verification on the visual dispaly 452. Several different types of information may be required. Typically the information relates to the structure, as the number of landings and the landing location of dual door openings. Other parameters relate to the type of elevator drive, as hydraulic or cable; and other characteristics of the drive apparatus which affect its control. Parameters concerned with the operation of the elevator relate to the timing of door opening and closing, the location of the car and condition of the doors in the absence of a service demand, the nature of emergency service and the like. Other system options which are typical are glow lights for the call buttons, a car position indicator, car arrival signals, etc. These require output signals from the control and must be specified in establishing the program and setting up the output circuit boards.

With the job parameters and control options specified, processor 450 assigns I/O terminals at step 462 and calculates the address transformation tables to correspond with the terminal configuration in step 463. The I/O card rack configuration is printed at 464 and a listing of parts is printed at step 465.

Processor 450 then turns to the program library standby program memory 453 and in step 466 pulls together all the needed program source material. An assembler program is called up from memory 453 at step 467. Before actually modifying the program source modules for the installation parameters, the operator is prompted at step 468 to determine whether a printout or listing of the program will be required. If the answer at step 469 is affirmative, processor 450 executes step 470 assembling and printing the program. If it is determined at step 419 that a printed listing of the program is not required, the program is assembled and only the error listing printed, step 471.

Processor 450, after correction of any errors, initiates the program utilized in programing the PROMs which are to be used in the elevator control, step 472. The operator is next prompted to insert a PROM in programer 454, step 474. When this is accomplished, the operator actuates a Run switch, step 475. Before proceeding with the transfer of the program to the PROM, processor 450 determines whether the PROM is erased at step 476. If it is not, an appropriate message is given the operator at step 477 and the routine returns to step 474. If the PROM is erased, the routine provides for a transfer of program information to the PROM and verification that it has been properly recorded, at step 478. At step 479, it is determined whether the recording of information on the PROM was successful. If it was not, step 480 notifies the operator and the routine returns to step 474. If the transfer of information was successful, step 481 determines whether additional PROMs are to be programed as the control may require greater capacity than is available on a single element. If additional PROMs are to be programmed, the routine returns to step 474. If no further PROM is necessary, a Checksum for the PROMs is printed at step 482 and the control design and assembly is completed.

The control for an elevator system may be modified by substituting a PROM (or PROMs) with the new program. Unless changes are made in the input and output circuits, no rewiring is required. The Host computer accomplishes in minutes the generation of a control that requires days of engineering and drafting work in a hard wired elevator control system.

I claim:

1. In an elevator system having an elevator car movable through a multiple landing structure to provide service to the landings, means providing input information regarding car condition and service requirements and means responsive to control signals for moving the car through the structure and operating the doors thereof, an improved control usable in a system and structure having a set of unique physical parameters, comprising:

a memory for storing input information, having assigned addresses for the input information of systems and structures of many different physical parameters;

input circuits connected with the means for providing input information to transmit the input information to the memory;

a PROM with a series of sequential program function blocks for operating the elevator system;

a central processor unit for carrying out the sequential programs with respect to the system input information in the memory, generating control signals for the system; and output circuits connected with the central processor unit for transmitting control signals to the means for moving the car and operating the doors thereof.

2. The elevator system control of claim 1 in which programs of the PROM correlate the input circuits with the assigned addresses in the memory for the information.

3. The elevator system control of claim 1 in which the programs of the PROM correlate the control signals from the central processor unit with the output circuits.

4. The elevator system control of claim 1 in which programs of the PROM correlate the input circuits with the assigned addresses in the memory for the information and the control signals from the central processor unit with the output circuits.

5. The elevator control system of claim 1 in which the input and output circuits are matched with the input information providing means and the control signal responsive means respectively for the unique physical parameters of the system and structure.

6. The elevator system control of claim 1 in which the memory has assigned addresses for the storage of elements of status information generated as an output of said central processor unit and serving as an input to said central processor unit to provide for interaction between elements of said series of sequential program function blocks.

7. The elevator system control of claim 1 in which programs of the PROM correlate the input circuits with the assigned addresses in the memory for the input information from the elevator system and the control signals from the central processor unit with the output circuits, the input and output circuits are matched with the input information providing means and the control signal responsive means respectively for the unique physical parameters of the system and structure; and the memory has assigned addresses for the storage of elements of status information generated as an output of said central processor unit and serving as an input to said central processor unit to provide for interaction between different elements of said series of sequential program function blocks.

8. The method of operating an elevator system having an elevator car in a multiple landing structure the system having means for moving the car through the structure and for operating the doors thereof to provide service to the landings, the system including a control with a memory having assigned addresses for information concerning structures and cars of various parameters, input means for transmitting input information concerning system conditions from the structure and car to the memory, output circuits for transmitting control signals to the structure and to the car moving and door operating means for moving the car and operating the doors thereof, a PROM with sequential operating programs for the system and a central processor unit for carrying out said programs with respect to the system information in the memory, the operating method comprising:

storing at the assigned addresses of the memory information concerning the system conditions;

sequentially performing the programs stored in the PROM;

transmitting control signals to the means for moving the car and operating the doors thereof; and moving the car and operating the doors thereof in accordance with said control signals.

9. The elevator system operating method of claim 8 including the further step of periodically checking the input means to determine the status of the input information concerning system conditions.

10. The elevator system operating method of claim 9 including the step of actuating the central processor unit periodically to check the input means and to update the memory with current input information.

11. The elevator system operating method of claim 8 in which the input means transmit input information concerning system safety conditions to the memory and including the steps of repeatedly checking system safety conditions and disabling the elevator system on occurrence of an unsafe condition.

12. The method of manufacture of a control for an elevator system having an elevator car movable through a multiple landing structure to provide service to the landings, the control including a memory, input and output circuits, a PROM and a central processor unit and being responsive to input information regarding car condition and service requirements and providing control signals for the movement of the car and the operation of the doors thereof, the method being usable in the manufacture of a control for a system with car and structure having a variety of parameters and comprising:

establishing addresses in the memory for information regarding car and structure condition and service requirements for a range of system parameters;

assigning input and output circuit means for the input information and output signals of the car and structure;

selecting sequential program blocks for the control;

adapting the sequential program blocks to the car and structure parameters; and programming the PROM to carry out the adapted sequential program blocks.

13. The method of manufacture of a control for an elevator system as defined in claim 12, including the step of calculating an address transformation table to correlate the memory addresses and the sequential program blocks with the assigned input and output circuit means.

* * * * *